US011521782B2

(12) United States Patent
Nakajima et al.

(10) Patent No.: US 11,521,782 B2
(45) Date of Patent: Dec. 6, 2022

(54) TRANSFORMER

(71) Applicant: HITACHI METALS, LTD., Tokyo (JP)

(72) Inventors: Shin Nakajima, Tokyo (JP); Hajime Itagaki, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 310 days.

(21) Appl. No.: 17/036,636

(22) Filed: Sep. 29, 2020

(65) Prior Publication Data

US 2021/0098175 A1 Apr. 1, 2021

(30) Foreign Application Priority Data

Sep. 30, 2019 (JP) ..... JP2019-178569
Jul. 23, 2020 (JP) ..... JP2020-125904

(51) Int. Cl.
*H01F 27/25* (2006.01)
*C22C 45/02* (2006.01)
*H01F 41/02* (2006.01)

(52) U.S. Cl.
CPC ..... *H01F 27/25* (2013.01); *C22C 45/02* (2013.01); *H01F 41/0226* (2013.01)

(58) Field of Classification Search
CPC .... H01F 27/25; H01F 41/0226; H01F 27/341; C22C 45/02
See application file for complete search history.

(56) References Cited

U.S. PATENT DOCUMENTS

| | | | | |
|---|---|---|---|---|
| 4,989,646 | A | 2/1991 | Nitta et al. | |
| 9,978,497 | B2 * | 5/2018 | Azuma | B23K 26/361 |
| 2008/0068121 | A1 | 3/2008 | Fukui et al. | |
| 2012/0154084 | A1 * | 6/2012 | Yoshizawa | H01F 1/15341 335/297 |

FOREIGN PATENT DOCUMENTS

| | | | |
|---|---|---|---|
| JP | S6129103 | A | 2/1986 |
| JP | S61258404 | A | 11/1986 |
| JP | H0253935 | A | 2/1990 |
| JP | H0332886 | A | 2/1991 |
| JP | 2005072160 | A | 3/2005 |
| JP | 2008071982 | A | 3/2008 |
| JP | 2017054896 | A | 3/2017 |

* cited by examiner

*Primary Examiner* — Tuyen T Nguyen
(74) *Attorney, Agent, or Firm* — Meunier Carlin & Curfman LLC

(57) ABSTRACT

A transformer includes an iron core formed by using an Fe-based amorphous alloy ribbon and a winding wound around the iron core. The ribbon includes dotted line laser radiation traces arranged on at least a first surface in a casting direction. Each of the dotted line laser radiation traces is formed by arranging laser radiation marks on the first surface along a width direction. A spot space is from 0.10 mm to 0.50 mm. In a case in which a line space is d1 (mm), and the spot space is d2 (mm), a number density D of the laser radiation marks (D=(1/d1)×(1/d2)) is from 0.05 marks/mm$^2$ to 0.50 marks/mm$^2$. An iron loss of the ribbon in a single sheet is 0.150 W/kg or less at a frequency of 60 Hz and a magnetic flux density of 1.45 T.

10 Claims, 6 Drawing Sheets

TRANSFORMER

CROSS-REFERENCE TO RELATED APPLICATIONS

This application claims the benefit of Japanese Patent Application No. 2019-178569 filed Sep. 30, 2019 in the Japan Patent Office and Japanese Patent Application No. 2020-125904 filed Jul. 23, 2020 in the Japan Patent Office, the entire disclosure of which is incorporated herein by reference.

TECHNICAL FIELD

The present disclosure relates to a transformer that includes an iron core formed by using an Fe-based amorphous alloy ribbon, and a winding wound around the iron core.

BACKGROUND

Transformers are used in various sizes, from small transformers to large transformers, with various configurations in every aspect of living environment. Due to such a large usage, the transformers have become major contributors to a problem of power loss; therefore, there has always been a demand for reducing the power loss in the transformers. There are standards in each country in the world to reduce the power loss of the transformers. Examples of major standards include JIS C 4304: 2013 and JIS C 4306: 2013 from the Japanese "Top-runner program"; DOE Standard of the US Department of Energy 10 CFR Part 431.196; the Commission Regulation (EU) No.548/2014, the National Standard of China GB 20052-2013; and Indian Standard IS 1180 (Part 1): 2018, all of which update the allowable power loss or the energy efficiency more strictly in every regular revision. In response to these standards and their revisions, high-efficiency transformers with less power loss are widely available.

A transformer includes an iron core and a winding as major components. Generally, a grain oriented electrical steel sheet is a common material for the iron core. However, as a material that causes a lower power loss than the grain oriented electrical steel sheet, an Fe-based amorphous alloy ribbon is also available. An iron core that is made of this Fe-based amorphous alloy ribbon is also used for the transformer.

The power loss of the transformer basically includes a no-load loss (iron loss) and a load loss (copper loss). A constant amount of the no-load loss is produced at the iron core at all times regardless of a load current of the transformer. The load loss is produced at the winding proportionally to the square of the load current. Considerations have been repeatedly made to reduce both of the losses, but further reductions are still required although some improvements have been achieved.

Some methods have been proposed to reduce the no-load loss of the transformer.

Japanese Unexamined Patent Application Publication No. 2017-054896 discloses that, to obtain an efficient iron core with a reduced no-load loss, a wound iron core made of an amorphous material is used; a joint structure of an iron core on an inner circumference of the wound iron core is an overlap joint, a joint structure of an iron core on an outer circumference of the wound iron core is a step lap joint, and the iron core on the inner circumference having the overlap joint structure accounts for 32% to 62% of the wound iron core.

Japanese Unexamined Patent Application Publication No. 2008-071982 discloses a transformer that includes an iron core made by forming a multi-layered amorphous alloy ribbon into a ring-shape, and a winding for excitation. An insulation thin film is formed on a surface of the amorphous alloy ribbon, which can help inhibit an increase in an eddy current loss and reduce the no-load loss of the transformer.

Japanese Unexamined Patent Application Publication No. 2005-072160 discloses a three-phase five-leg wound iron core transformer, in which magnetic materials for the wound iron core include both an amorphous alloy ribbon and an electrical steel sheet. Specifically, in this three-phase five-leg wound iron core transformer, wound iron cores on the outer side each of which are coupled only to one winding are electrical steel sheets; another wound iron core in the middle which is coupled to two windings is an amorphous alloy ribbon. This structure requires no reinforcing materials for holding the windings, and due to its compactness, this structure helps reduce man-hours and material costs of an assembling work. In addition, this structure provides an amorphous alloy ribbon wound iron core and a three-phase five-leg wound iron core transformer that achieves less no-load losses than a structure that has magnetic materials only including electrical steel sheets.

Efforts have been made to reduce the power losses with respect to the Fe-based amorphous alloy ribbon used as a material for the iron core.

For example, as methods of reducing an anomalous eddy current loss of the Fe-based amorphous alloy ribbon, a method that mechanically scratches a surface of the Fe-based amorphous alloy ribbon, and a method that segments the magnetic domain of Fe-based amorphous alloy ribbon by irradiating a surface of the Fe-based amorphous alloy ribbon by a laser light and locally melt and rapidly solidify the surface, a laser scribing method, is known.

With respect to the laser scribing method, for example, Japanese Examined Patent Application Publication No. H3-032886 discloses a method of segmenting the magnetic domain by first irradiating an amorphous alloy ribbon by a pulse laser in its width direction to locally and instantaneously melt a surface of the amorphous alloy ribbon, and then rapidly solidifying the melted surface to form amorphized spots in lines.

Japanese Unexamined Patent Application Publication No. S61-258404 discloses that a laser light is swept to irradiate the ribbon in a width direction of the ribbon while a surface temperature of the ribbon is 300° C. or more.

Japanese Examined Patent Application Publication No. H2-053935 discloses that a ribbon is locally heated to form strip-shaped crystalized regions in which the strips are arranged in lines in a longitudinal direction of this ribbon at intervals of from 2 mm to 100 mm, each with an angle θ, an angle with respect to the width direction of the ribbon, of 30 degrees or less, and a d/D ratio, the ratio of an average depth d in a direction of a thickness of the ribbon and the thickness D of the ribbon, is made to be 0.1 or more in each of the crystalized regions; and also at the same time, these regions are made to account for a volume percentage of 8% or less of the ribbon.

Japanese Unexamined Patent Application Publication No. S61-029103 discloses irradiation of a pulse laser light having a beam diameter narrowed to 0.5 mmφ or less to sufficiently extract capacities of a non-crystalline alloy that has a thickness (40 μm to 80 μm) greater than the thickness of conventional materials (20 μm to 30 μm). Specifically, it discloses that a non-crystalline alloy that has a width of 50 mm and a thickness of 65 μm is irradiated by a YAG laser with the following conditions: a frequency is 400 Hz; a beam diameter is 0.2 mmφ; an output power is 5W; a beam sweeping speed is 10 cm/see; and a space between laser marks is 5 mm.

PRIOR ART DOCUMENTS

Patent Documents

Patent Document 1: Japanese Unexamined Patent Application Publication No. 2017-054896

Patent Document 2: Japanese Unexamined Patent Application Publication No. 2008-071982

Patent Document 3: Japanese Unexamined Patent Application Publication No. 2005-072160

Patent Document 4: Japanese Examined Patent Application Publication No. H3-032886

Patent Document 5: Japanese Unexamined Patent Application Publication No. S61-258404

Patent Document 6: Japanese Examined Patent Application Publication No. H2-053935

Patent Document 7: Japanese Unexamined Patent Application Publication No. S61-029103

SUMMARY

Problems to be Solved by the Invention

As mentioned above, the power losses of the transformer mainly include the no-load loss produced in the iron core and the load-loss produced in the winding. To reduce the no-load loss of the transformer, it has been considered to use an Fe-based amorphous alloy ribbon that produces small iron loss. Particularly in a case of a distribution transformer, it is known that an average equivalent load factor that corresponds to an annual effective value of the load rate is as low as 15% as disclosed in "An Evaluation of Amorphous Transformer using Load Curve Pattern Model for Pole Transformer" by Takagi, Yamamoto, and Yamaji published in The Transactions of the Institute of Electrical Engineering of Japan B, A publication of Power and Energy Society, P885-892, Vol. 128 No. 6, 2008, or disclosed in Final Report, LOT 2: Distribution and power transformers Tasks 1-7 2010/ETE/R/106, January 2011. Thus, transformers using Fe-based amorphous alloy ribbons that produce small no-load loss are highly effective in view of an energy saving and a reduction of $CO_2$ emission.

As shown in Table 1 and Table 2 of JIS C2534:2017 (corresponding IEC Standards: IEC60404-8-11), the Fe-based amorphous alloy ribbons for the iron core of the transformer are broadly divided into two grades of materials, conventional grade and high permeability grade, each grade includes 16 types categorized based on the maximum iron loss and the minimum lamination factor. The Fe-based amorphous alloy ribbon with the least iron loss has a maximum iron loss of 0.08 W/kg at a frequency of 50 Hz and a magnetic flux density of 1.3 T; and a maximum iron loss of 0.11 W/kg at a frequency 60 Hz and the magnetic flux density of 1.3 T. However, it is necessary to use an Fe-based amorphous alloy ribbon that has less iron loss than one just mentioned above to obtain a transformer with higher efficiency.

The aforementioned laser scribing method has been tested to reduce the iron loss of the amorphous alloy ribbon, however, it has not yet reached the minimum iron loss shown in Table 1 and Table 2 of JIS C2534:2017 (for example, see embodiments in Japanese Examined Patent Application Publication No. H3-032886, Japanese Unexamined Patent Application Publication No. S61-258404, Japanese Examined Patent Application Publication No. H2-053935, and Japanese Unexamined patent Application Publication No. S61-029103).

A figure of a surface of the amorphous alloy ribbon may be largely deformed due to a laser irradiation. If the deformation is large, then the lamination factor of the amorphous alloy ribbon becomes low when formed into an iron core by, for example, winding and layering. Such a large deformation of the figure of the surface of the amorphous alloy ribbon is not preferable in terms of characteristics of the iron core. Desired characteristics of the iron core also cannot be obtained due to crystallization if a crystalized region is formed by locally heating the ribbon.

The present disclosure desirably provides a transformer that includes an iron core formed of an Fe-based amorphous alloy ribbon that achieves less iron loss than the minimum iron loss shown in Table 1 and Table 2 of JIS C2534:2017, and that achieves a reduced no-load loss of this iron core.

Means for Solving the Problems

Specific measures for solving the aforementioned problems include the following aspects.

A first aspect of the present disclosure is a transformer including an iron core formed by using an Fe-based amorphous alloy ribbon, and a winding wound around the iron core. The Fe-based amorphous alloy ribbon includes dotted line laser radiation traces on at least a first surface of the Fe-based amorphous alloy ribbon. The dotted line laser radiation traces are arranged in a casting direction of the Fe-based amorphous alloy ribbon. Each dotted line laser radiation trace extends along a width direction of the Fe-based amorphous alloy ribbon. The width direction is orthogonal to the casting direction. The dotted line laser radiation trace is formed by arranging laser radiation marks along the width direction. A space between center lines of the dotted line laser radiation traces adjacent to one another at a central part of the Fe-based amorphous alloy ribbon in the width direction is a line space. A space between adjacent two of the center points is a spot space. The spot space is from 0.10 mm to 0.50 mm. In a case in which the line space is d1 (mm), the spot space is d2 (mm), and number density D of the laser radiation marks is determined by a following formula: $D=(1/d1)\times(1/d2)$, the number density D of the laser radiation marks is from 0.05 marks/$mm^2$ to 0.50 marks/$mm^2$. An iron loss of the Fe-based amorphous alloy ribbon in a single sheet is 0.150 W/kg or less at a frequency of 60 Hz and a magnetic flux density of 1.45 T.

The transformer is preferably a single-phase transformer; and wherein a no-load loss of the transformer per weight of the iron core may be 0.15 W/kg or less at 50 Hz, or 0.19 W/kg or less at 60 Hz.

The transformer is preferably a three-phase transformer; and wherein a no-load loss of the transformer per weight of the iron core may be 0.19 W/kg or less at 50 Hz, or 0.24 W/kg or less at 60 Hz.

A rated capacity of the transformer is preferably 10 kVA or more.

The line space d1 is preferably 10 mm to 60 mm.

A proportion of a length of each of the dotted line laser radiation traces to a total width of the Fe-based amorphous alloy ribbon is preferably in a range from 10% to 50% each in both directions from a midpoint of the Fe-based amorphous alloy ribbon towards ends of the Fe-based amorphous alloy ribbon in the width direction.

A thickness of the Fe-based amorphous alloy ribbon is preferably 18 μm to 35 μm.

In a case in which the Fe-based amorphous alloy ribbon contains Fe, Si, B, and an impurity with a total content of Fe, Si, and B in the Fe-based amorphous alloy ribbon being 100 atomic %, a content of Fe is preferably 78 atomic % or more, a content of B is preferably 10 atomic % or more, a total content of B and Si is preferably from 17 atomic % to 22 atomic %.

The Fe-based amorphous alloy ribbon preferably includes a free solidified surface and a roll contacting surface; and a maximum cross-sectional height Rt on the free solidified surface, except for a portion where the dotted line laser radiation traces are formed, is preferably 3.0 μm or less.

The dotted line laser radiation traces are preferably formed at least inside an area of central six-eighths of eight equal sections of the Fe-based amorphous alloy ribbon divided in the width direction, excluding two-eights on both ends of the Fe-based amorphous alloy ribbon.

Effects of the Invention

One aspect of the present disclosure provides a transformer with reduced no-load loss.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

Figure 1:
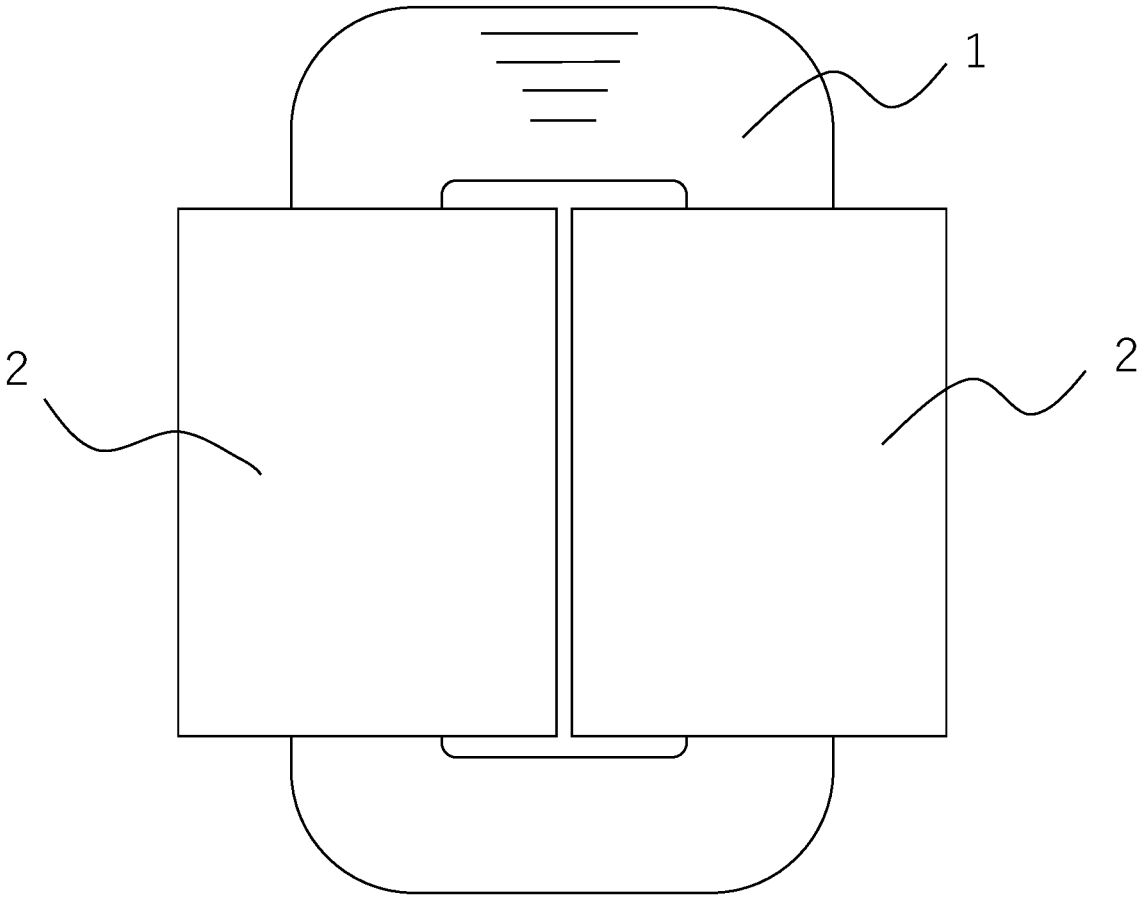
FIG. 1 is a schematic diagram showing one example of a transformer of an embodiment of the present disclosure.

In the present disclosure, a range of numerical values expressed with a preposition "to" means that the range includes the numerical values written before and after the preposition "to" as a minimum value and a maximum value. In the present disclosure, in a set of ranges of numerical values written in stages, the maximum value or the minimum value included in one range of numerical values may be replaced with the maximum value or the minimum value in another range of numerical values. In the present disclosure, the maximum value or the minimum value of a range of numerical values may be replaced with a value mentioned in an embodiment.

In the present disclosure, a word "process" includes not only "an independent process" but also a process that is not clearly distinctive from different processes if the original object of the process has been achieved.

In the present disclosure, an Fe-based amorphous alloy ribbon (hereinafter, also simply referred to as "the ribbon") means a ribbon that is made from an Fe-based amorphous alloy.

In the present disclosure, the Fe-based amorphous alloy means an amorphous alloy that contains Fe (iron) as its main component. The main component is a component with the highest content ratio (mass %).

Hereinafter, embodiments of the present disclosure will be described. It should be noted that the present disclosure is not limited to the following embodiments but can be appropriately modified within a scope of the technical ideas of the present disclosure.

A transformer in the embodiment of the present disclosure includes an iron core formed by using an Fe-based amorphous alloy ribbon, and a winding wound around the iron core. The Fe-based amorphous alloy ribbon includes dotted line laser radiation traces arranged on at least one surface of the Fe-based amorphous alloy ribbon in a casting direction of the Fe-based amorphous alloy ribbon. Each dotted line laser radiation trace extends along a width direction of the Fe-based amorphous alloy ribbon. The width direction is orthogonal to the casting direction. The dotted line laser radiation trace is formed by arranging laser radiation marks along the width direction. Each laser radiation mark has a center point. Each dotted line laser radiation trace has a center line that may pass through a plurality of the center points of the laser radiation marks. A space between two of the center lines of the dotted line laser radiation traces adjacent to one another at a central part of the Fe-based amorphous alloy ribbon in the width direction is a line space. A space between adjacent two of the center points is a spot space. The spot space is from 0.10 mm to 0.50 mm. In a case in which the line space is d1 (mm), the spot space is d2 (mm), and number density D of the laser radiation marks is determined by a following formula: $D=(1/d1)\times(1/d2)$, the number density D of the laser radiation marks is from 0.05 marks/mm$^2$ to 0.50 marks/mm$^2$. An iron loss of the Fe-based amorphous alloy ribbon in a single sheet is 0.150 W/kg or less at a frequency of 60 Hz and a magnetic flux density of 1.45 T.

A single sheet of the aforementioned Fe-based amorphous alloy ribbon exhibits a reduced iron loss also at a frequency of 50 Hz and the magnetic flux density of 1.45 T. Desirably, the iron loss of the Fe-based amorphous alloy ribbon in a single sheet is 0.120 W/kg or less at the frequency of 50 Hz and the magnetic flux density of 1.45 T.

Preferably, the iron loss of the Fe-based amorphous alloy ribbon is 0.08 W/kg or less at the frequency of 50 Hz and the magnetic flux density of 1.3 T, or 0.11 W/kg or less at the frequency of 60 Hz and the magnetic flux density of 1.3 T.

Preferably, the iron core used in the present embodiment is a circular iron core that is prepared by bending Fe-based amorphous alloy ribbons into curves in an overlapping manner. Preferably, two or more of this circular iron core are used in combination. The iron core may also be a laminated iron core made by piling the Fe-based amorphous alloy ribbons, or a wound iron core made by winding the Fe-based amorphous alloy ribbons.

Preferably, the transformer of in the embodiments of the present disclosure is a single-phase transformer or a three-phase transformer. A rated capacity of the transformer is preferably 10 kVA or more.

Preferably, the no-load loss of the iron core per weight of the single-phase transformer is 0.15 W/kg or less at 50 Hz, or 0.19 W/kg or less at 60 Hz.

Preferably, the no-load loss of the iron core per weight of the three-phase transformer is 0.19 W/kg or less at 50 Hz, or 0.24 W/kg or less at 60 Hz.

First Embodiment

An example configuration of the iron core and the windings in the present embodiment is shown in FIG. 1. The transformer shown in FIG. 1 includes a circular iron core 1 prepared by bending layered Fe-based amorphous alloy ribbons into curves in an overlapping manner, and windings 2 wound around the iron core 1. The windings 2 are placed inside the iron core when the iron core is still open before being overlapped. The iron core 1 in the first embodiment includes one circular iron core (a single-phase two-leg wound iron core). Table 1 shows main characteristics and a weight of a single-phase, 50 Hz, oil-immersed transformer of the present disclosure with a rated capacity of 10 kVA that uses the iron core 1 of the first embodiment and complies with JIS C 4304: 2013 (hereinafter, this transformer is referred to as Example 1) with comparison to Conventional Example 1. The Fe-based amorphous alloy ribbons used in Example 1 had the aforementioned characteristics; thus, in accordance with the definitions of "Letters for Types of Amorphous Strips" in section 5 of JIS C 2534: 2017, the iron core material for Example 1 was expressed as 25AMP06-88. The Fe-based amorphous alloy ribbons used in Conventional Example 1 were 25AMP08-88. It should be noted that the characteristics of the following Example 1 to Example 8 are expressed in numbers obtained from analysis by simulation.

The Fe-based amorphous alloy ribbons used in Example 1 were 25 μm in thickness and 142.2 mm in width; included the dotted line laser radiation traces on a free solidified surface; had the line space of the dotted line laser radiation traces of 20 mm and the spot space of 0.20 mm; had 0.25 marks/mm$^2$ of the number density D of the laser radiation marks; had the iron loss of 0.083 W/kg at the frequency of 50 Hz and the magnetic flux density of 1.45 T; and had the iron loss of 0.105 W/kg at a frequency 60 Hz and the magnetic flux density of 1.45 T.

The Fe-based amorphous alloy ribbons used in Conventional Example 1 were 25 μm in thickness and 142.2 mm in width; included no laser radiation marks; had the iron loss of 0.130 W/kg at the frequency of 50 Hz and the magnetic flux density of 1.45 T; and had the iron loss of 0.167 W/kg at the frequency of 60 Hz and the magnetic flux density of 1.45 T.

In Example 1 and Conventional Example 1, the circular iron core 1 had 1,875 layers of the ribbons. The weight of the iron core 1 is shown in Table 1.

A primary winding of the transformer was formed with a copper wire with a diameter of 0.9 mm which was wound 3,143 turns. A secondary winding of the transformer was formed with a rectangular aluminum wire with a size of 3.2 mm×6.0 mm; the secondary winding included a plurality of windings wound 100 turns and connected in parallel.

TABLE 1

| Specification of Transformer | Example 1 | Conventional Example 1 |
|---|---|---|
| Applied Standard for Transformer | JIS C 4304: 2013 | |
| Rated Capacity(kVA) | 10 | |
| Primary Winding Voltage (kV) | 6.6 | |
| Secondary Winding Voltage (V) | 210-105 | |
| Number of Phase | 1 | |
| Frequency (Hz) | 50 | |
| Iron Core Material | 25AMP06-88 (Nominal Thickness: 0.025 mm, Width: 142.2 mm) | 25AMP08-88 (Nominal thickness: 0.025 mm, Width: 142.2 mm) |
| Iron Core Type | Single-phase Two-leg Wound Iron Core | |
| Primary Winding | φ0.9 mm Cu Wire 3,143 turns | |
| Secondary Winding | 3.2 mm × 6.0 mm Al Rectangular Wire 2 parallel/100 turns | |
| No-load Loss (W) | 6.0 | 8.0 |
| No-load Loss per Iron Core Weight (W/kg) | 0.149 | 0.197 |
| Ratio of No-load Loss per Iron CoreWeight | 0.756 | 1.000 |
| Load Loss (W) | 225 | 225 |
| Standard Efficiency Value (%) at Output Power Equivalent to Rated Capacity | 97.60 | |
| Efficiency (%) at Output Power Equivalent to Rated Capacity | 97.74 | 97.71 |
| Energy Consumption Efficiency Standard Value (W) | 60 | |
| Energy Consumption Efficiency (W) | 42 | 44 |
| Energy Consumption Efficiency Ratio | 0.70 | 0.73 |
| Iron Core Weight (kg) | 40.0 | 40.0 |
| Primary Winding Weight (kg) | 9.5 | 9.5 |
| Secondary Winding Weight (kg) | 3.7 | 3.7 |
| Weight (kg) of Structure Material of Transformer including Heat Dissipation Fin | 24.4 | 24.4 |
| Insulation Oil Weight (kg) | 30.9 | 30.8 |
| Main Material Weight (kg) of Transformer | 108.5 | 108.4 |
| Ratio by Weight of Main Material of Transformer | 1.00 | 1.00 |
| $CO_2$ Emission Factor (kg/kWh) | 0.490 | |
| Annual $CO_2$ Emission (t/Year) at 15% Load Factor | 0.047 | 0.056 |
| Annual $CO_2$ Emission Rate at 15% Load Factor | 0.85 | 1.00 |

Table 1 shows that the no-load loss of the iron core per weight is 0.149 W/kg in Example 1, which is about 25% reduction from 0.197 W/kg of that in Conventional Example 1.

In response to this reduction, the energy consumption efficiency ratio compared with the energy consumption efficiency standard value defined in JIS C 4304: 2013 (see "Energy Consumption Efficiency Ratio" in Table 1; the same applies hereinafter) was improved to 0.70 in Example 1 from 0.73 in Conventional Example 1. Table 1 also shows that an annual $CO_2$ emission at an average equivalent load factor of a distribution transformer being 15% was improved by about 15%. This is apparent by looking at "Annual $CO_2$ Emission Ratio at 15% Load Factor" on Table 1, which is 0.85 (the same applies hereinafter).

[Example 2]

As a second example of the transformer of the present embodiment configured with the iron core and the windings as shown in FIG. 1, Table 2 shows main characteristics and a weight of a single-phase, 60 Hz, oil-immersed transformer of the present disclosure with a rated capacity of 10 kVA that complies with JIS C 4304: 2013 (hereinafter, this transformer is referred to as Example 2) with comparison to Conventional Example 2.

The Fe-based amorphous alloy ribbons used in Example 2 were the same as those used in Example 1; and the Fe-based amorphous alloy ribbons used in Conventional Example 2 were the same as those of Conventional Example 1.

In Example 2 and Conventional Example 2, the circular iron core 1 had 1,785 layers of the ribbons. The weight of the iron core 1 is shown in Table 2.

The primary winding of this transformer was formed with a copper wire with a diameter of 0.9 mm which was wound 2,776 turns. The secondary winding of the transformer was formed with a rectangular aluminum wire with a size of 2.6 mm×6.0 mm; the secondary winding included a plurality of windings wound 88 turns and connected in parallel.

TABLE 2

| Specification of Transformer | Example 2 | Conventional Example 2 |
|---|---|---|
| Applied Standard for Transformer | JIS C 4304: 2013 | |
| Rated Capacity(kVA) | 10 | |
| Primary Winding Voltage (kV) | 6.6 | |
| Secondary Winding Voltage (V) | 210-105 | |
| Number of Phase | 1 | |
| Frequency (Hz) | 60 | |
| Iron Core Material | 25AMP06-88 (Nominal Thickness: 0.025 mm, Width: 142.2 mm) | 25AMP08-88 (Nominal Thickness: 0.025 mm, Width: 142.2 mm) |
| Iron Core Type | Single-phase Two-leg Wound Iron Core | |
| Primary Winding | φ0.9 mm Cu Wire 2,776 turns | |
| Secondary Winding | 2.6 mm × 6.0 mm Al Rectangular Wire 2 parallel/88 turns | |
| No-load Loss (W) | 6.7 | 9.2 |
| No-load Loss per Iron Core Weight (W/kg) | 0.189 | 0.259 |
| Ratio of No-load Loss per Iron CoreWeight | 0.728 | 1.000 |
| Load Loss (W) | 204 | 204 |
| Standard Efficiency Value (%) at Output Power Equivalent to Rated Capacity | 97.68 | |
| Efficiency (%) at Output Power Equivalent to Rated Capacity | 97.93 | 97.90 |
| Energy Consumption Efficiency Standard Value (W) | 58 | |
| Energy Consumption Efficiency (W) | 39 | 42 |
| Energy Consumption Efficiency Ratio | 0.68 | 0.72 |
| Iron Core Weight (kg) | 35.5 | 35.5 |
| Primary Winding Weight (kg) | 8.3 | 8.3 |
| Secondary Winding Weight (kg) | 3.0 | 3.0 |
| Weight (kg) of Structure Material of Transformer including Heat Dissipation Fin | 23.1 | 23.1 |
| Insulation Oil Weight (kg) | 28.2 | 28.1 |
| Main Material Weight (kg) of Transformer | 98.2 | 98.1 |
| Ratio by Weight of Main Material of Transformer | 1.00 | 1.00 |
| $CO_2$ Emission Factor (kg/kWh) | 0.490 | |
| Annual $CO_2$ Emission (t/Year) at 15% Load Factor | 0.048 | 0.059 |
| Annual $CO_2$ Emission Rate at 15% Load Factor | 0.82 | 1.00 |

Table 2 shows that the no-load loss of the iron core per weight was 0.189 W/kg in Example 2, which was about 27% reduction from 0.259 W/kg of that in Conventional Example 2.

In response to this reduction, the energy consumption efficiency ratio compared with the energy consumption efficiency standard value defined in JIS C 4304: 2013 was improved to 0.68 in Example 2 from 0.72 in Conventional Example 2. Table 2 also shows that the annual $CO_2$ emission at the average equivalent load factor of a distribution transformer being 15% was improved by about 18%.

[Example 3]

As a third example of the transformer of the present embodiment configured with the iron core and the windings as shown in FIG. 1, Table 3 shows main characteristics and a weight of a single-phase, 50 Hz, oil-immersed transformer of the present disclosure with a rated capacity of 30 kVA that complies with JIS C 4304: 2013 (hereinafter, this transformer is referred to as Example 3) with comparison to Conventional Example 3.

The Fe-based amorphous alloy ribbons used in Example 3 were 25 μm in thickness and 213.4 mm in width; included the dotted line laser radiation traces on the free solidified surface; had the line space of the dotted line laser radiation traces of 20 mm and the spot space of 0.20 mm; had 0.25 marks/mm$^2$ of the number density D of the laser radiation marks; had the iron loss of 0.085 W/kg at the frequency of 50 Hz and the magnetic flux density of 1.45 T; and had the iron loss of 0.108 W/kg at the frequency of 60 Hz and the magnetic flux density of 1.45 T.

The Fe-based amorphous alloy ribbons used in Conventional Example 3 were 25 μm in thickness and 213.4 mm in width; included no laser radiation marks; had the iron loss of 0.132 W/kg at the frequency of 50 Hz and the magnetic flux density of 1.45 T; and had the iron loss of 0.168 W/kg at the frequency of 60 Hz and the magnetic flux density of 1.45 T.

In Example 3 and Conventional Example 3, the circular iron core 1 had 3,015 layers of the ribbons. The weight of the iron core 1 is shown in Table 3.

The primary winding of this transformer was formed with a copper wire with a diameter of 1.4 mm which was wound 1,509 turns. The secondary winding of this transformer was formed with a rectangular aluminum wire with a size of 3.2 mm×15 mm; the secondary winding included a plurality of windings wound 44 turns and connected in parallel.

TABLE 3

| Specification of Transformer | Example 3 | Conventional Example 3 |
|---|---|---|
| Applied Standard for Transformer | JIS C 4304: 2013 | |
| Rated Capacity(kVA) | 30 | |
| Primary Winding Voltage (kV) | 6.6 | |
| Secondary Winding Voltage (V) | 210-105 | |
| Number of Phase | 1 | |
| Frequency (Hz) | 50 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Single-phase Two-leg Wound Iron Core | |
| Primary Winding | φ1.4 mm Cu Wire 1,509 turns | |
| Secondary Winding | 3.2 mm × 15 mm Al Rectangular Wire 2 parallel/44 turns | |
| No-load Loss (W) | 12 | 17 |
| No-load Loss per Iron Core Weight (W/kg) | 0.138 | 0.197 |
| Ratio of No-load Loss per Iron CoreWeight | 0.700 | 1.000 |
| Load Loss (W) | 499 | 500 |
| Standard Efficiency Value (%) at Output Power Equivalent to Rated Capacity | 98.10 | |
| Efficiency (%) at Output Power Equivalent to Rated Capacity | 98.32 | 98.30 |
| Energy Consumption Efficiency Standard Value (W) | 135 | |
| Energy Consumption Efficiency (W) | 92 | 97 |
| Energy Consumption Efficiency Ratio | 0.68 | 0.72 |
| Iron Core Weight (kg) | 87.5 | 87.5 |
| Primary Winding Weight (kg) | 11.5 | 11.5 |
| Secondary Winding Weight (kg) | 7.4 | 7.4 |
| Weight (kg) of Structure Material of Transformer including Heat Dissipation Fin | 33.9 | 34.1 |
| Insulation Oil Weight (kg) | 55.2 | 56.0 |
| Main Material Weight (kg) of Transformer | 195.4 | 196.4 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 0.100 | 0.122 |
| Annual $CO_2$ Emission Rate at 15% Load Factor | 0.82 | 1.00 |

Table 3 shows that the no-load loss of the iron core per weight was 0.138 W/kg in Example 3, which was about 30% reduction from 0.197 W/kg of that in Conventional Example 3.

In response to this reduction, the energy consumption efficiency ratio compared with the energy consumption efficiency standard value defined in JIS C 4304: 2013 was improved to 0.68 in Example 3 from 0.72 in Conventional Example 3. Table 3 also shows that the annual $CO_2$ emission at the average equivalent load factor of a distribution transformer being 15% was improved by about 18%. In addition, the no-load loss of the iron core per weight was 0.138 W/kg in Example 3, improving by 0.011 W/kg from 0.149W/kg in Example 1. The reason for this improvement was that an increase in size of the iron core caused a length of the curve of the iron core to be small in proportion to a length of a magnetic path of the iron core, which inhibited an increase in no-load loss due to residual stress at the curve of the iron core.

[Example 4]

As a fourth example of the transformer of the present embodiment configured with the iron core and the windings as shown in FIG. 1, Table 4 shows main characteristics and a weight of a single-phase, 60 Hz, oil-immersed transformer of the present disclosure with a rated capacity of 30 kVA that complies with JIS C 4304: 2013 (hereinafter, this transformer is referred to as Example 4) with comparison to Conventional Example 4.

The Fe-based amorphous alloy ribbons used in Example 4 were the same as those used in Example 3; and the Fe-based amorphous alloy ribbons used in Conventional Example 4 were the same as those used in Conventional Example 3.

In Example 4 and Conventional Example 4, the circular iron core 1 had 2,715 layers of the ribbons. The weight of the iron core 1 is shown in Table 4.

The primary winding of this transformer was formed with a copper wire with a diameter of 1.3 mm which was wound 1,509 turns. The secondary winding of the transformer was formed with a rectangular aluminum wire with a size of 4.0 mm×13 mm; the secondary winding included a plurality of windings wound 44 turns and connected in parallel.

TABLE 4

| Specification of Transformer | Example 4 | Conventional Example 4 |
|---|---|---|
| Applied Standard for Transformer | JIS C 4304: 2013 | |
| Rated Capacity(kVA) | 30 | |
| Primary Winding Voltage (kV) | 6.6 | |
| Secondary Winding Voltage (V) | 210-105 | |
| Number of Phase | 1 | |
| Frequency (Hz) | 60 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Single-phase Two-leg Wound Iron Core | |
| Primary Winding | φ1.3 mm Cu Wire 1,509 turns | |
| Secondary Winding | 4.0 mm × 13 mm Al Rectangular Wire 2 parallel/44 turns | |
| No-load Loss (W) | 13 | 19 |
| No-load Loss per Iron Core Weight (W/kg) | 0.180 | 0.256 |
| Ratio of No-load Loss per Iron CoreWeight | 0.700 | 1.000 |
| Load Loss (W) | 462 | 463 |
| Standard Efficiency Value (%) at Output Power Equivalent to Rated Capacity | 98.19 | |
| Efficiency (%) at Output Power Equivalent to Rated Capacity | 98.44 | 98.42 |
| Energy Consumption Efficiency Standard Value (W) | 130 | |
| Energy Consumption Efficiency (W) | 87 | 93 |
| Energy Consumption Efficiency Ratio | 0.67 | 0.72 |
| Iron Core Weight (kg) | 74.4 | 74.4 |
| Primary Winding Weight (kg) | 10.6 | 10.6 |
| Secondary Winding Weight (kg) | 6.9 | 6.9 |
| Weight (kg) of Structure Material of Transformer including Heat Dissipation Fin | 32.0 | 32.2 |
| Insulation Oil Weight (kg) | 50.3 | 51.2 |
| Main Material Weight (kg) of Transformer | 174.1 | 175.2 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 0.102 | 0.127 |
| Annual $CO_2$ Emission Rate at 15% Load Factor | 0.81 | 1.00 |

Table 4 shows that the no-load loss of the iron core per weight was 0.180 W/kg in Example 4, which was about 30% reduction from 0.256 W/kg of that in Conventional Example 4.

In response to this reduction, the energy consumption efficiency ratio compared to the energy consumption efficiency standard value defined in JIS C 4304: 2013 was improved to 0.67 in Example 4 from 0.72 in Conventional Example 4. Table 4 also shows that the annual $CO_2$ emission at the average equivalent load factor of a distribution transformer being 15% was improved by about 19%. In addition, the no-load loss of the iron core per weight was 0.180 W/kg in Example 4, improving by 0.009 W/kg from 0.189 W/kg in Example 2. The reason for this reduction was the same as the reason mentioned in the Example 3.

[Example 5]

Figure 2:
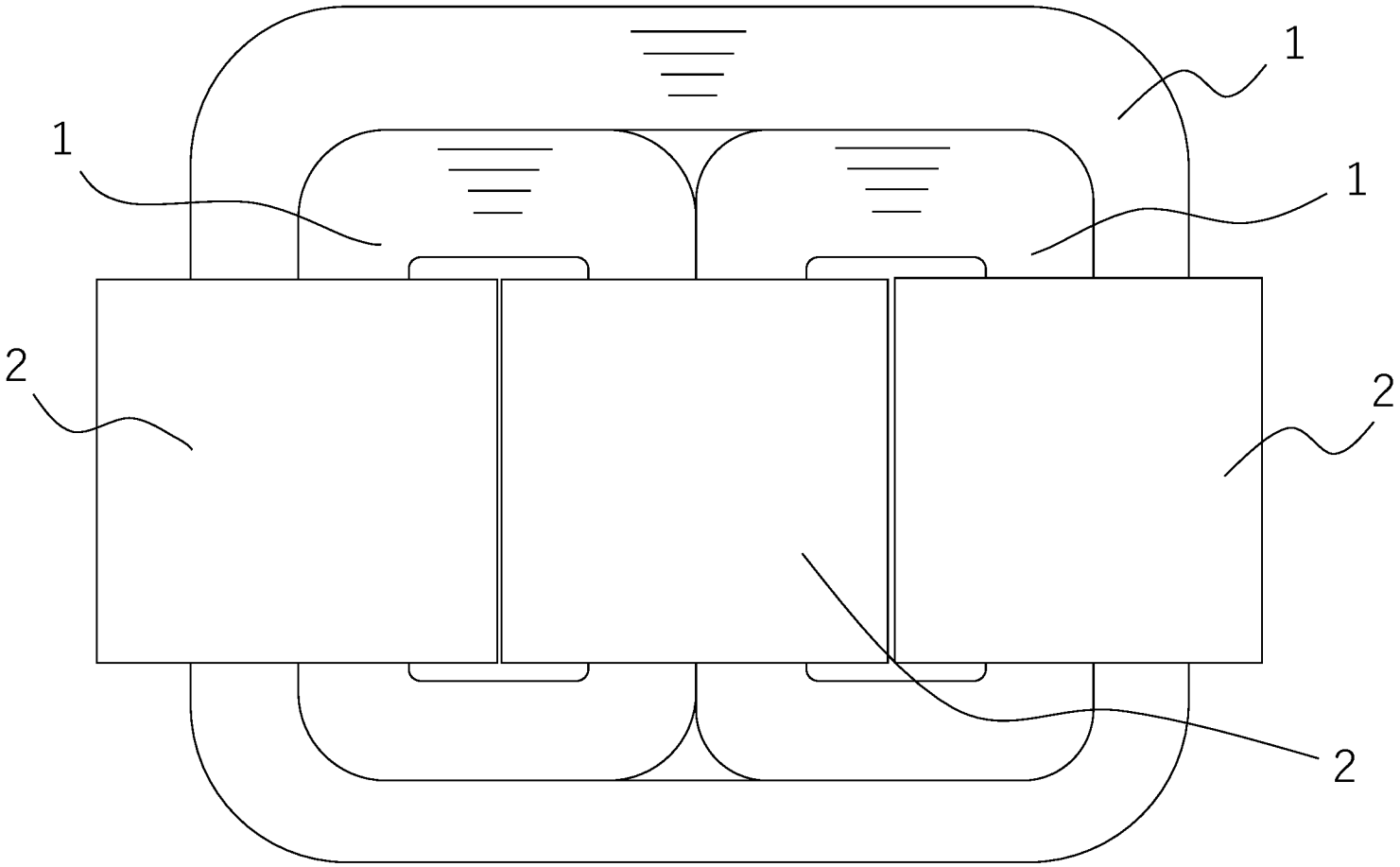
FIG. 2 is a schematic diagram showing another example of the transformer of the present disclosure.

Another example configuration of the iron core and the windings in the present embodiment is shown in FIG. 2. The transformer shown in FIG. 2 includes three-phase three-leg wound iron cores formed by combining the circular iron cores 1 prepared by bending the layered Fe-based amorphous alloy ribbons into curves in an overlapping manner (combining three circular iron cores), and three sets of the windings 2 wound around the iron cores. Table 5 shows main characteristics and a weight of a three-phase, 50 Hz, oil-immersed transformer of the present disclosure with the rated capacity of 100 kVA that uses the iron cores of the present embodiment and complies with JIS C 4304: 2013 (hereinafter, this transformer is referred to as Example 5) with comparison to Conventional Example 5.

The Fe-based amorphous alloy ribbons used in Example 5 were the same as those used in Example 3; and the Fe-based amorphous alloy ribbons used in Conventional Example 5 were the same as those used in Conventional Example 3.

In Example 5 and Conventional Example 5, the circular iron cores 1 each had 3,480 layers of the ribbons. The weight of the iron cores 1 (total weight of the three circular iron cores 1) is shown in Table 5.

The primary winding of this transformer was formed with a copper wire with a diameter of 2.2 mm which was wound 653 turns by star connection. The secondary winding of this transformer was formed with an aluminum sheet with a size of 0.4 mm×247 mm which was wound 36 turns by delta connection.

TABLE 5

| Specification of Transformer | Example 5 | Conventional Example 5 |
|---|---|---|
| Applied Standard for Transformer | JIS C 4304: 2013 | |
| Rated Capacity(kVA) | 100 | |
| Primary Winding Voltage (kV) | 6.6 | |
| Secondary Winding Voltage (kV) | 0.21 | |
| Number of Phase | 3 | |
| Frequency (Hz) | 50 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Three-phase Three-leg Wound Iron Core | |
| Primary Winding | φ2.2 mm Cu Wire 653 turns in Star Connection | φ2.2 mm Cu Wire 653 turns in Star Connection |
| Secondary Winding | 0.4 mm × 247 mm Al Sheet 36 turns in Delta Connection | 0.4 mm × 248 mm Al Sheet 36 turns in Delta Connection |
| No-load Loss (W) | 45 | 64 |
| No-load Loss per Iron Core Weight (W/kg) | 0.188 | 0.269 |
| Ratio of No-load Loss per Iron CoreWeight | 0.699 | 1.000 |
| Load Loss (W) | 1,582 | 1,595 |
| Standard Efficiency Value (%) at Output Power Equivalent to Rated Capacity | 98.71 | |
| Efficiency (%) at Output Power Equivalent to Rated Capacity | 98.40 | 98.37 |
| Energy Consumption Efficiency Standard Value (W) | 409 | |
| Energy Consumption Efficiency (W) | 298 | 319 |
| Energy Consumption Efficiency Ratio | 0.73 | 0.78 |
| Iron Core Weight (kg) | 237 | 237 |
| Primary Winding Weight (kg) | 66 | 66 |
| Secondary Winding Weight (kg) | 23 | 23 |
| Weight (kg) of Structure Material of Transformer including Heat Dissipation Fin | 91 | 92 |
| Insulation Oil Weight (kg) | 118 | 122 |
| Main Material Weight (kg) of Transformer | 535 | 541 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 0.344 | 0.428 |
| Annual $CO_2$ Emission Rate at 15% Load Factor | 0.80 | 1.00 |

Table 5 shows that the no-load loss of the iron core per weight was 0.188 W/kg in Example 5, which was about 30% reduction from 0.269 W/kg of that in Conventional Example 5.

In response to this reduction, the energy consumption efficiency ratio compared to the energy consumption efficiency standard value defined in JIS C 4304: 2013 was improved to 0.73 in Example 5 from 0.78 in Conventional Example 5. Table 5 also shows that the annual $CO_2$ emission at the average equivalent load factor of a distribution transformer being 15% was improved by about 20%.

[Example 6]

As another example of the transformer of the present embodiment configured with the iron cores and the windings as shown in FIG. 2, Table 6 shows main characteristics and a weight of a three-phase, 60 Hz, oil-immersed transformer of the present disclosure with the rated capacity of 100 kVA that complies with JIS C 4304: 2013 (hereinafter, this transformer is referred to as Example 6) with comparison to Conventional Example 6.

The Fe-based amorphous alloy ribbons used in Example 6 were the same as those used in Example 3; and the Fe-based amorphous alloy ribbons used in Conventional Example 6 were the same as those used in Conventional Example 3.

In Example 6 and Conventional Example 6, the circular iron cores 1 each had 2,895 layers of the ribbons. The weight of the iron cores 1 is shown in Table 6.

The primary winding and the secondary winding of this transformer were the same as those in Example 5 and Conventional Example 5.

TABLE 6

| Specification of Transformer | Example 6 | Conventional Example 6 |
|---|---|---|
| Applied Standard for Transformer | JIS C 4304: 2013 | |
| Rated Capacity(kVA) | 100 | |
| Primary Winding Voltage (kV) | 6.6 | |
| Secondary Winding Voltage (kV) | 0.21 | |
| Number of Phase | 3 | |
| Frequency (Hz) | 60 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Three-phase Three-leg Wound Iron Core | |
| Primary Winding | φ2.2 mm Cu Wire 653 turns in Star Connection | φ2.2 mm Cu Wire 653 turns in Star Connection |
| Secondary Winding | 0.4 mm × 247 mm Al Sheet 36 turns in Delta Connection | 0.4 mm × 248 mm Al Sheet 36 turns in Delta Connection |
| No-load Loss (W) | 44 | 63 |
| No-load Loss per Iron Core Weight (W/kg) | 0.238 | 0.339 |
| Ratio of No-load Loss per Iron CoreWeight | 0.703 | 1.000 |
| Load Loss (W) | 1,607 | 1,600 |
| Standard Efficiency Value (%) at Output Power Equivalent to Rated Capacity | 98.71 | |
| Efficiency (%) at Output Power Equivalent to Rated Capacity | 98.37 | 98.36 |
| Energy Consumption Efficiency Standard Value (W) | 392 | |
| Energy Consumption Efficiency (W) | 301 | 319 |
| Energy Consumption Efficiency Ratio | 0.77 | 0.81 |
| Iron Core Weight (kg) | 186 | 186 |
| Primary Winding Weight (kg) | 63 | 63 |
| Secondary Winding Weight (kg) | 19 | 19 |
| Weight (kg) of Structure Material of Transformer including Heat Dissipation Fin | 85 | 87 |
| Insulation Oil Weight (kg) | 103 | 106 |
| Main Material Weight (kg) of Transformer | 456 | 461 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 0.344 | 0.425 |
| Annual $CO_2$ Emission Rate at 15% Load Factor | 0.81 | 1.00 |

Table 6 shows that the no-load loss of the iron core per weight was 0.238 W/kg in Example 6, which was about 30% reduction from 0.339 W/kg of that in Conventional Example 6.

In response to this reduction, the energy consumption efficiency ratio compared to the energy consumption efficiency standard value defined in JIS C 4304: 2013 was improved to 0.77 in Example 6 from 0.81 in Conventional Example 6. Table 6 also shows that the annual $CO_2$ emission at the average equivalent load factor of a distribution transformer being 15% was improved by about 19%.

[Example 7]

As another example of the transformer of the present embodiment configured with the iron cores and the windings as shown in FIG. 2, Table 7 shows main characteristics and a weight of a three-phase, 50 Hz, oil-immersed transformer of the present disclosure with the rated capacity of 500 kVA that complies with JIS C 4304: 2013 (hereinafter, this transformer is referred to as Example 7) with comparison to Conventional Example 7.

The Fe-based amorphous alloy ribbons used in Example 7 were the same as those used in Example 3; and the Fe-based amorphous alloy ribbons used in Conventional Example 7 were the same as those used in Conventional Example 3.

In Example 7, the circular iron cores 1 had 5,685 layers of the ribbons. In Conventional Example 7, the circular iron cores 1 had 5,955 layers of the ribbons. The weight of the iron cores 1 (total weight of the three circular iron cores 1) is shown in Table 7.

The primary winding of Example 7 was formed with a rectangular copper wire with a size of 3.5 mm×4.5 mm which was wound 399 turns by star connection. The secondary winding of Example 7 was formed with an aluminum sheet with a size of 1.3 mm×438 mm which was wound 22 turns by delta connection. The primary winding of Conventional Example 7 was formed with a rectangular copper wire with a size of 3.2 mm×5.0 mm which was wound 381 turns by star connection. The secondary winding of Conventional Example 7 was formed with an aluminum sheet with a size of 1.4 mm×383 mm which was wound 21 turns by delta connection.

TABLE 7

| Specification of Transformer | Example 7 | Conventional Example 7 |
|---|---|---|
| Applied Standard for Transformer | JIS C 4304: 2013 | |
| Rated Capacity(kVA) | 500 | |
| Primary Winding Voltage (kV) | 6.6 | |
| Secondary Winding Voltage (kV) | 0.21 | |
| Number of Phase | 3 | |
| Frequency (Hz) | 50 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Three-phase Three-leg Wound Iron Core | |
| Primary Winding | 3.5 mm × 4.5 mm Cu Rectangular Wire 399 turns in Star Connection | 3.2 mm × 5.0 mm Cu Rectangular Wire 381 turns in Star Connection |
| Secondary Winding | 1.3 mm × 438 mm Al Sheet 22 turns in Delta Connection | 1.4 mm × 383 mm Al Sheet 21 turns in Delta Connection |
| No-load Loss (W) | 105 | 155 |
| No-load Loss per Iron Core Weight (W/kg) | 0.172 | 0.246 |
| Ratio of No-load Loss per Iron CoreWeight | 0.700 | 1.000 |
| Load Loss (W) | 6,394 | 6,338 |
| Standard Efficiency Value (%) at Output Power Equivalent to Rated Capacity | 98.71 | |
| Efficiency (%) at Output Power Equivalent to Rated Capacity | 98.72 | 98.72 |
| Energy Consumption Efficiency Standard Value (W) | 1,250 | |
| Energy Consumption Efficiency (W) | 1,128 | 1,169 |
| Energy Consumption Efficiency Ratio | 0.90 | 0.93 |
| Iron Core Weight (kg) | 612 | 629 |
| Primary Winding Weight (kg) | 208 | 205 |
| Secondary Winding Weight (kg) | 105 | 97 |
| Weight (kg) of Structure Material of Transformer including Heat Dissipation Fin | 228 | 231 |
| Insulation Oil Weight (kg) | 361 | 373 |
| Main Material Weight (kg) of Transformer | 1,514 | 1,535 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 1.069 | 1.275 |
| Annual $CO_2$ Emission Rate at 15% Load Factor | 0.84 | 1.00 |

Table 7 shows that the no-load loss of the iron core per weight was 0.172 W/kg in Example 7, which was about 30% reduction from 0.246 W/kg of that in Conventional Example 7.

In response to this reduction, the energy consumption efficiency ratio compared to the energy consumption efficiency standard value defined in JIS C 4304: 2013 was improved to 0.90 in Example 7 from 0.93 in Conventional Example 7. Table 7 also shows that the annual $CO_2$ emission at the average equivalent load factor of a distribution transformer being 15% was also improved by about 16%. In addition, the no-load loss of the iron core per weight was 0.172 W/kg in Example 7, improving 0.016 W/kg from 0.188 W/kg in the Example 5. The reason for this improvement was that an increase in size of the iron core caused the length of the curve of the iron core to be small in proportion to the length of the magnetic path of the iron core, which inhibited an increase in no-load loss due to residual stress at the curve of the iron core.

[Example 8]

Figure 3:
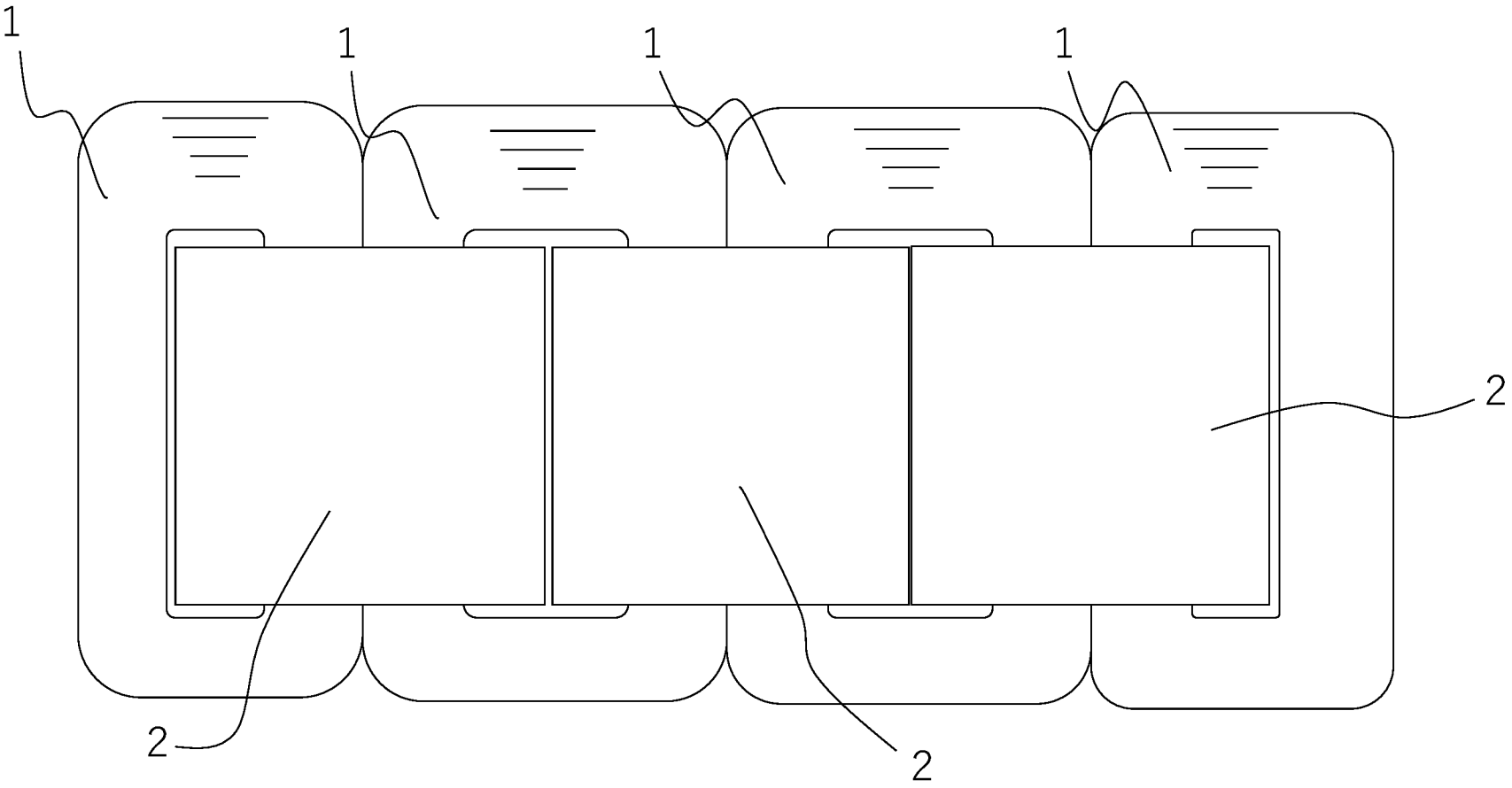
FIG. 3 is a schematic diagram showing yet another embodiment of the present disclosure.

Another example configuration of the iron cores and the windings of the present embodiment is shown in FIG. 3. The transformer shown in FIG. 3 includes three-phase five-leg wound iron cores formed by combining the circular iron cores 1 prepared by bending the layered Fe-based amorphous alloy ribbons into curves in an overlapping manner, and three sets of the windings 2 wound around the iron cores. Table 8 shows main characteristics and a weight of a three-phase, 50 Hz, oil-immersed transformer of the present disclosure with the rated capacity of 1000 kVA that uses the iron cores of the present embodiment and complies with JIS C 4304: 2013 (hereinafter, this transformer is referred to as Example 8) with comparison to Conventional Example 8.

The Fe-based amorphous alloy ribbons used in Example 8 were the same as those used in Example 3; and the Fe-based amorphous alloy ribbons used in Conventional Example 8 is the same as those used in Conventional Example 3.

In Example 8 and Conventional Example 8, the circular iron cores 1 each had 2,610 layers of the ribbons. The circular iron cores 1 each included two iron cores stacked in a vertical direction of FIG. 3. The weight of the iron cores 1 (total weight of the eight circular iron cores) is shown in Table 8.

The primary winding of Example 8 was formed with a rectangular copper wire with a size of 2.8 mm×7.0 mm which was wound 377 turns by delta connection. The secondary winding of Example 8 was formed with an aluminum sheet with a size of 3.0 mm×305 mm which was wound 12 turns by delta connection. The primary winding of Conventional Example 8 was formed with a rectangular copper wire with a size of 2.8 mm×7.0 mm which was wound 377 turns by delta connection. The secondary winding of Conventional Example 8 was formed with an aluminum sheet with a size of 3.2 mm×306 mm which was wound 12 turns by delta connection.

TABLE 8

| Specification of Transformer | Example 8 | Conventional Example 8 |
|---|---|---|
| Applied Standard for Transformer | JIS C 4304: 2013 | |
| Rated Capacity(kVA) | 1000 | |
| Primary Winding Voltage (kV) | 6.6 | |
| Secondary Winding Voltage (kV) | 0.21 | |
| Number of Phase | 3 | |
| Frequency (Hz) | 50 | |
| Iron Core Material | 25AMP06-88 (Nominal Thickness: 0.025 mm, Width: 213.4 mm) | 25AMP08-88 (Nominal Thickness: 0.025 mm, Width: 213.4 mm) |
| Iron Core Type | Three-phase Five-leg Wound Iron Core | |
| Primary Winding | 2.8 mm × 7.0 mm Cu Rectangular Wire 377 turns in Delta Connection | 2.8 mm × 7.0 mm Cu Rectangular Wire 377 turns in Delta Connection |
| Secondary Winding | 3.0 mm × 305 mm Al Sheet 12 turns in Delta Connection | 3.2 mm × 306 mm Al Sheet 12 turns in Delta Connection |
| No-load Loss (W) | 186 | 267 |
| No-load Loss per Iron Core Weight (W/kg) | 0.188 | 0.269 |
| Ratio of No-load Loss per Iron CoreWeight | 0.700 | 1.000 |
| Load Loss (W) | 11,055 | 10,761 |
| Standard Efficiency Value (%) at Output Power Equivalent to Rated Capacity | 98.80 | |
| Efficiency (%) at Output Power Equivalent to Rated Capacity | 98.89 | 98.91 |
| Energy Consumption Efficiency Standard Value (W) | 2,960 | |
| Energy Consumption Efficiency (W) | 2,950 | 2,958 |
| Energy Consumption Efficiency Ratio | 0.996 | 0.999 |
| Iron Core Weight (kg) | 986 | 993 |
| Primary Winding Weight (kg) | 347 | 350 |
| Secondary Winding Weight (kg) | 143 | 154 |
| Weight (kg) of Structure Material of Transformer including Heat Dissipation Fin | 777 | 779 |
| Insulation Oil Weight (kg) | 619 | 629 |
| Main Material Weight (kg) of Transformer | 2,872 | 2,904 |
| Ratio by Weight of Main Material of Transformer | 0.99 | 1.00 |
| $CO_2$ Emission Factor (kg/kWh) | 0.490 | |
| Annual $CO_2$ Emission (t/Year) at 15% Load Factor | 1.866 | 2.186 |
| Annual $CO_2$ Emission Rate at 15% Load Factor | 0.85 | 1.00 |

Table 8 shows that the no-load loss of the iron core per weight was 0.188 W/kg in Example 8, which was about 30% reduction from 0.269 W/kg of that in Conventional Example 8.

In response to this reduction, the energy consumption efficiency ratio compared to the energy consumption efficiency standard value defined in JIS C 4304: 2013 was improved to 0.996 in Example 8 from 0.999 in Conventional Example 8. Table 8 also shows that the annual $CO_2$ emission at the average equivalent load factor of a distribution transformer being 15% was also improved by about 15%.

As described above, the transformer of the present disclosure can reduce the no-load loss and thus is particularly effective in reducing transmission loss of, for example, distribution transformers with low average equivalent load factors, and in reducing $CO_2$ emission. The examples in the present disclosure provides detailed explanations about applications of wound iron core transformers; nevertheless, it should be noted that the effect of reducing the no-load loss can also be obtained in applications of laminated iron core transformers.

[Fe-Based Amorphous Alloy Ribbon]

The Fe-based amorphous alloy ribbon used in the present embodiment will be explained hereinafter.

As mentioned above, the Fe-based amorphous alloy ribbon used in the present embodiment includes the dotted line laser radiation traces on at least one surface of the Fe-based amorphous alloy ribbon. The dotted line laser radiation traces are arranged in the casting direction of the Fe-based amorphous alloy ribbon. Each dotted line laser radiation trace extends along the width direction of the Fe-based amorphous alloy ribbon. The dotted line laser radiation trace is formed by arranging the laser radiation marks along the width direction. Each laser radiation mark has the center point. Each dotted line laser radiation trace has the center line passing through a plurality of the center points of the laser radiation marks. A space between two of the center lines of the dotted line laser radiation traces adjacent to one another at the central part of the Fe-based amorphous alloy ribbon in the width direction is the line space. The space between adjacent two of the center points is the spot space. The spot space is from 0.10 mm to 0.50 mm. In a case in which the line space is d1 (mm), the spot space is d2 (mm), and the number density D of the laser radiation marks is determined by the following formula: $D=(1/d1)\times(1/d2)$, the number density D of the laser radiation marks is from 0.05 marks/$mm^2$ to 0.50 marks/$mm^2$. The iron loss of the Fe-based amorphous alloy ribbon in a single sheet is 0.150 W/kg or less at the frequency of 60 Hz and the magnetic flux density of 1.45 T.

A single sheet of the aforementioned Fe-based amorphous alloy ribbon exhibits a reduced iron loss also at the frequency of 50 Hz and the magnetic flux density of 1.45 T.

In addition, a single sheet of the aforementioned Fe-based amorphous alloy ribbon exhibits a reduced iron loss at the frequency of 50 Hz and the magnetic flux density of 1.3 T, or at the frequency of 60 Hz and the magnetic flux density of 1.3 T.

Owing to the aforementioned configurations, the Fe-based amorphous alloy ribbon of the present disclosure exhibits a reduced iron loss under the condition that a magnetic flux density is 1.45 T and inhibits an increase in the exciting power under the condition that a magnetic flux density is 1.45 T.

The first is to explain the effect that the iron loss is reduced under the condition that a magnetic flux density is 1.45 T. As described above, the Fe-based amorphous alloy ribbon of the present disclosure includes the dotted line laser radiation traces each formed by arranging the laser radiation marks. The Fe-based amorphous alloy ribbon of the present disclosure includes these dotted line laser radiation traces and thereby the magnetic domain of the ribbon is segmented. Consequently, the Fe-based amorphous alloy ribbon exhibits a reduced iron loss under the condition that the magnetic flux density is 1.45 T.

As such, the act of forming the dotted line laser radiation traces on the Fe-based amorphous alloy ribbon per se contributes to reducing the iron loss under the condition that the magnetic flux density is 1.45 T.

The next is to explain the effect that the increase in the exciting power is inhibited under the condition that the magnetic flux density is 1.45 T. Although the details will be mentioned later, the inventor of the present disclosure and others found that formation of the laser radiation marks on the Fe-based amorphous alloy ribbon might cause the increase in the exciting power under the condition that the magnetic flux density was 1.45 T. The increase in the exciting power under the condition that the magnetic flux density is 1.45 T is not desirable as it cause a decrease in a magnetic flux density B0.08.

Regarding this point, the Fe-based amorphous alloy ribbon of the present disclosure is configured as follows. As mentioned earlier, the line space is the space between two of the center lines of the dotted line laser radiation traces arranged in the casting direction and adjacent to one another at the central part of the ribbon in a direction orthogonal to the casting direction (also referred to as the width direction). And the spot space is the space between adjacent two of the center points of the laser radiation marks that form each dotted line laser radiation trace. The spot space is from 0.10 mm to 0.50 mm. In a case in which the line space is d1 (mm), the spot space is d2 (mm), and the number density D of the laser radiation marks is determined by the following formula: $D=(1/d1)\times(1/d2)$, the number density D of the laser radiation marks is from 0.05 marks/$mm^2$ to 0.50 marks/$mm^2$. In other words, the spot space of the laser radiation marks and the line space of the dotted line laser radiation traces are broadened to some extent on the Fe-based amorphous alloy ribbon of the present disclosure, and thereby the number of the laser radiation marks is reduced to some extent (in other words, the number density of the laser radiation marks is reduced to some extent).

In the Fe-based amorphous alloy ribbon of the present disclosure, an increase in the exciting power under the condition that the magnetic flux density is 1.45 T is inhibited by broadening the spot space of the laser radiation marks, broadening the line space of the dotted line laser radiation traces, and reducing the number density of the laser radiation marks.

In a case in which the dotted line laser radiation traces do not reach the central part of the ribbon in the width direction, the line space may be measured by virtually extending the dotted line laser radiation traces to the central part of the ribbon in the width direction.

Moreover, a decrease in the magnetic flux density B0.08 due to an increase in the exciting power is also inhibited.

As explained above, the Fe-based amorphous alloy ribbon of the present disclosure exhibits a reduced iron loss under the condition that the magnetic flux density is 1.45 T and inhibits an increase in the exciting power under the condition that the magnetic flux density is 1.45 T.

Hereinafter, the aforementioned effect exhibited by the Fe-based amorphous alloy ribbon of the present disclosure will be explained in further detail with comparison to conventional techniques.

Conventionally, the iron loss and the exciting power have been generally measured under the condition that the magnetic flux density is 1.3 T.

For example, Japanese Unexamined Patent Application Publication No. S61-029103 disclosed in its examples that an iron loss is reduced under the condition that the magnetic flux density is 1.3 T by irradiating a free solidified surface of an Fe-based amorphous alloy ribbon by YAG laser with 5 mm spaces between laser marks (with a number density D being 0.8 marks/mm$^2$).

International Patent Application Publication No. 2011/030907 discloses in the fourth example that, in a case in which a free solidified surface of an Fe-based amorphous alloy ribbon is irradiated by a laser light to form recesses in lines with 5 mm intervals in a longitudinal direction (with a number density D being 0.8 marks/mm$^2$), an iron loss and an apparent power are reduced under the condition that the magnetic flux density is 1.3 T when conditions, such as a ratio $t_1/T$ of a depth t1 of the recesses to a thickness T of the ribbon is in a range of 0.025 to 0.18, are satisfied. The apparent power described in International Patent Application Publication No. 2011/030907 corresponds to the exciting power in the present disclosure.

International Patent Application Publication No. 2012/102379 disclosed in its first example that an iron loss and an exciting power are reduced under the condition that the magnetic flux density is 1.3 T in a case in which waveform unevenness is formed on a free solidified surface of an Fe-based amorphous alloy ribbon, the waveform unevenness have width direction troughs arranged at approximately regular intervals in a longitudinal direction, and the mean amplitude of the troughs is 20 mm or less.

Recently, however, with the object of downsizing transformers manufactured by using Fe-based amorphous alloy ribbons, it has sometimes been required to reduce the iron loss and the exciting power not under the condition that the magnetic flux density is 1.3 T but under the condition that the magnetic flux density is 1.45 T.

The inventor of the present disclosure and others have considered this issue and found that some types of Fe-based amorphous alloy ribbons (specifically, those having a higher number density of the laser radiation marks) exhibited a significant increase in the exciting power when measured under the condition that the magnetic flux density is 1.45 T, even though it exhibited a certain decrease in the exciting power when measured under the condition that the magnetic flux density is 1.3 T.

This finding will be discussed in detail hereinafter with reference to FIG. 5 and FIG. 6.

Figure 5:
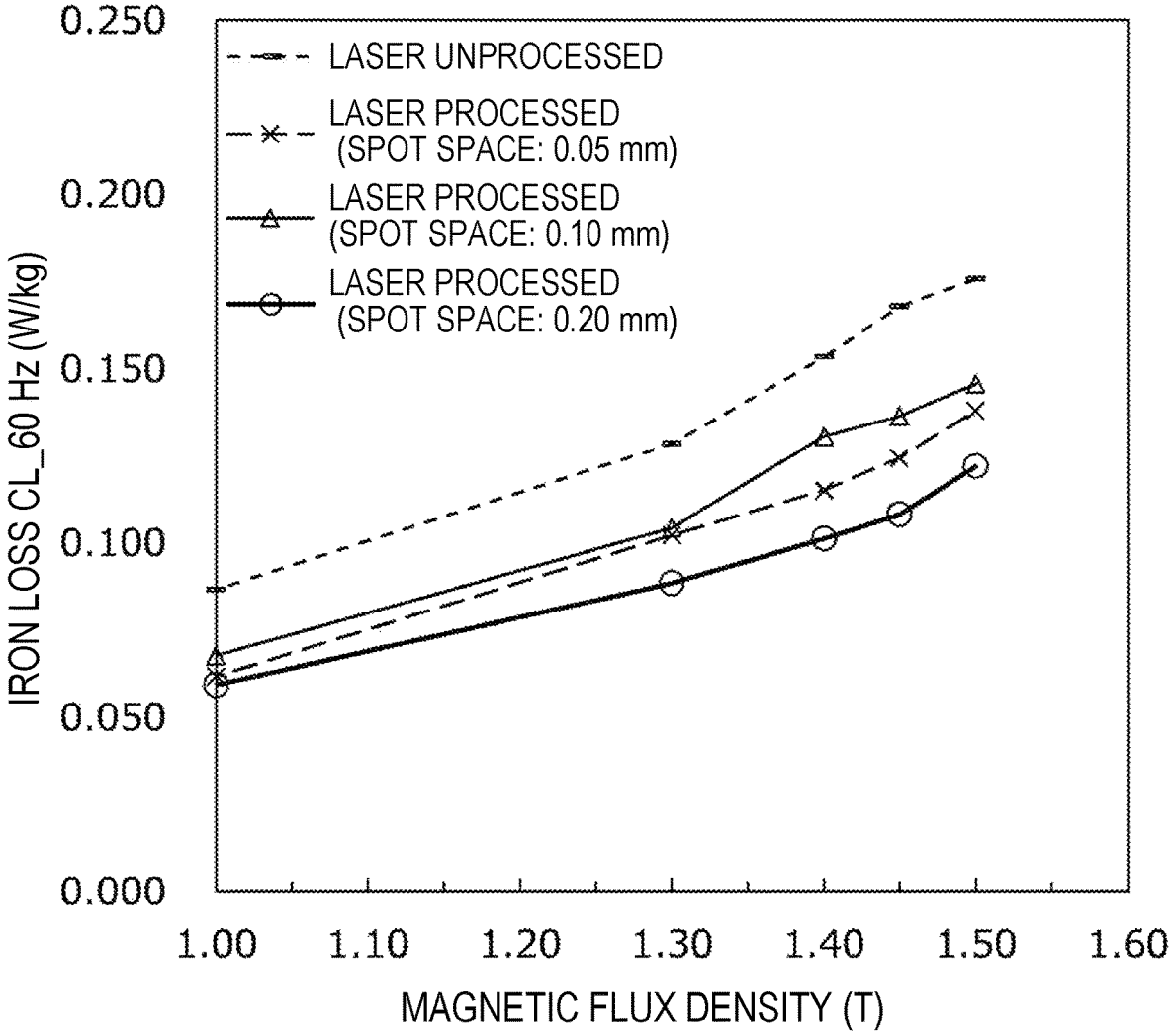
FIG. 5 is a graph showing a relationship between magnetic flux density and iron loss with varying spot spaces.

FIG. 5 is a graph showing a relationship between the magnetic flux density and the iron loss with respect to four types of Fe-based amorphous alloy ribbons, namely, an Fe-based amorphous alloy ribbon with no laser processing; a laser-processed Fe-based amorphous alloy ribbon with a spot space of 0.05 mm; a laser processed Fe-based amorphous alloy ribbon with a spot space of 0.10 mm; and a laser processed Fe-based amorphous alloy ribbon with a spot space of 0.20 mm.

Figure 6:
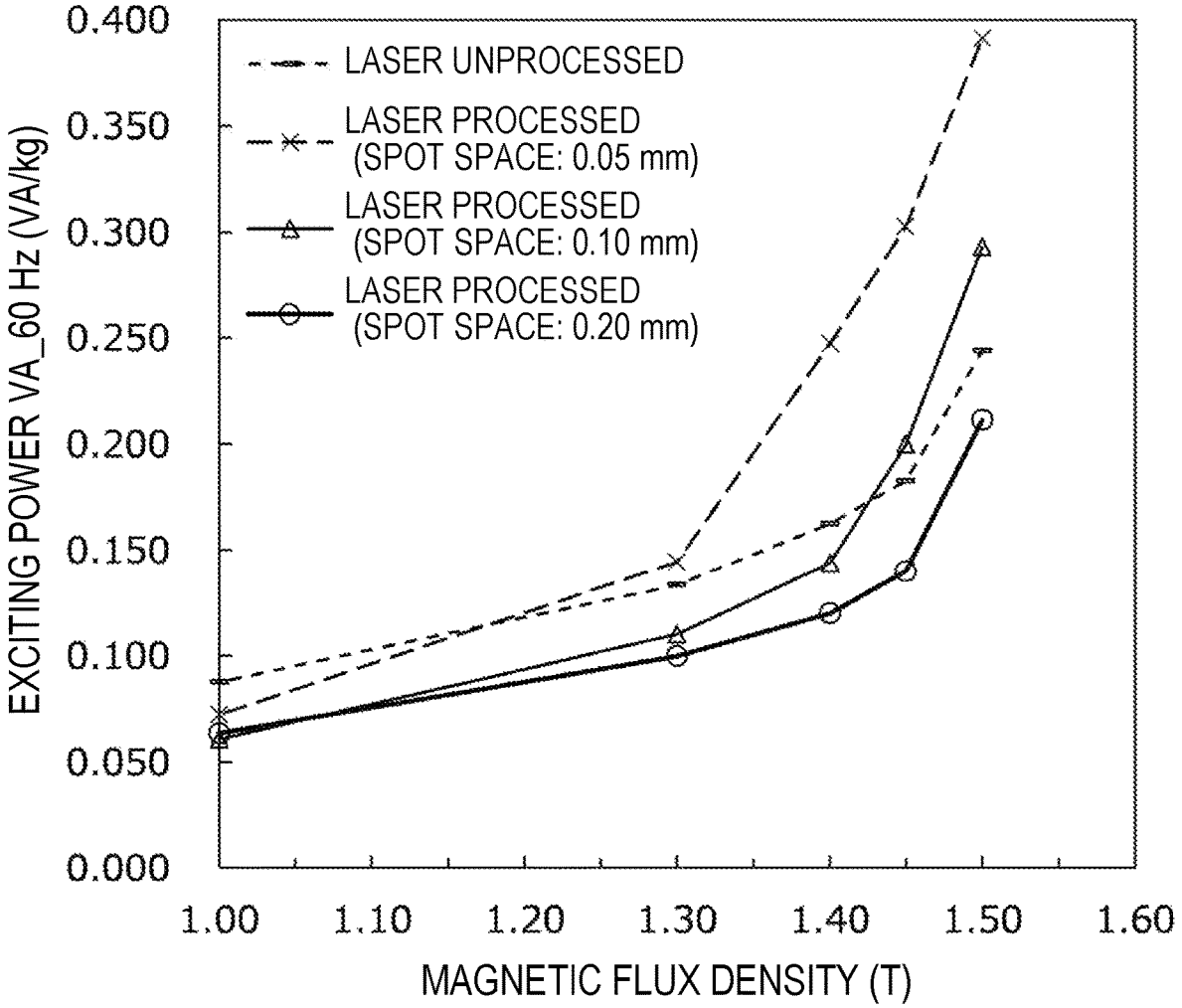
FIG. 6 is a graph showing a relationship between magnetic flux density and exciting power with varying spot spaces.

FIG. 6 is a graph similarly showing a relationship between the magnetic flux density and the exciting power.

In FIG. 5 and FIG. 6, the laser-processed Fe-based amorphous alloy ribbon with the spot space of 0.05 mm was formed under the same conditions as in Comparison Example 102, which will be explained later, except that the line space was 60 mm. The number density D was 0.33 marks/mm$^2$.

In FIG. 5 and FIG. 6, the laser-processed Fe-based amorphous alloy ribbon with the spot space of 0.10 mm was formed under the same conditions as in Example 101, which will be explained later, except that the line space was 60 mm. The number density D was 0.167 marks/mm$^2$.

In FIG. 5 and FIG. 6, the laser-processed Fe-based amorphous alloy ribbon with the spot space of 0.20 mm was formed under the same conditions as in Example 103, which will be explained later (the line space was 20 mm). The number density D was 0.25 marks/mm$^2$.

In FIG. 5 and FIG. 6, the Fe-based amorphous alloy ribbon with no laser processing was manufactured under the same conditions as in Comparison Example 101, which will be explained later.

As shown in FIG. 5, in all of the four types of Fe-based amorphous alloy ribbons, the iron loss gradually increased as the magnetic flux density increased.

In addition, FIG. 5 also shows that the Fe-based amorphous alloy ribbon exhibited a reduced iron loss by applying a laser processing with a spot space of 0.05 mm, a spot space of 0.10 mm, or a spot space of 0.20 mm. The effect per se that the ribbon exhibits a reduced iron loss by applying the laser processing is disclosed in publicly-known documents, such as Japanese Unexamined Patent Application Publication No. S61-029103 and International Patent Application Publication No. 2011/030907.

As shown in FIG. 6, there were no significant differences in the exciting power under the condition that the magnetic flux density is 1.3 T between the four types of the Fe-based amorphous alloy ribbons. It shows that the presence of absence of the laser processing had no substantial effects on the exciting power under the condition that the magnetic flux density is 1.3 T. Accordingly, if the condition is that the iron loss and the exciting power are measured with the magnetic flux density of 1.3 T, then the effect of reducing the iron loss can be obtained with substantially no increases in the exciting power by applying the laser processing on the Fe-based amorphous alloy ribbon.

However, in terms of the Fe-based amorphous alloy ribbon with the spot space of 0.05 mm, it is shown in FIG. 6 that the exciting power sharply increased when the magnetic flux density exceeded 1.3 T. Consequently, it is shown that the Fe-based amorphous alloy ribbon with the spot space of 0.05 mm exhibited a significant increase in the exciting power under the condition that the magnetic flux density was 1.45 T compared to other three types of the Fe-based amorphous alloy ribbons.

As mentioned above, the inventor of the present disclosure and others found that there is a tendency that the exciting power increases significantly under the condition that the magnetic flux density is 1.45 T when the spot space of the laser radiation marks is excessively narrow, such as 0.05 mm (see FIG. 6). Furthermore, the inventor of the present disclosure and others found that an increase in the exciting power under the condition that the magnetic flux density is 1.45 T can be inhibited by extending the spot space, such as to 0.20 mm, (in other words, by decreasing the number density of the laser radiation marks) (see FIG. 6).

The inventor of the present disclosure and others also found that an effect of reducing the iron loss by the laser processing can be still obtained even when the spot space is extended, such as to 0.10 mm or 0.20 mm (see FIG. 5).

These findings are also shown in Table 9 of the examples, which will be explained later.

Accordingly, it is found that the Fe-based amorphous alloy ribbon with an inhibited increase in the exciting power and with a low iron loss can be obtained under the condition that the magnetic flux density is 1.45 T by extending the spot space and by decreasing the number density D.

The inventor of the present disclosure and others also found that an increase in the exciting power under the condition that the magnetic flux density is 1.45 T can also be inhibited and that the effect of reducing the iron loss by laser processing can also be obtained by extending the line space of the dotted line laser radiation traces (for example, extending the line space to 10 mm or more) likewise the case in which the spot space is extended.

This finding is described in Table 10, which will be introduced later.

As disclosed in, for example, International Patent Application Publication No. 2012/102379, it has been conventionally tried to reduce the iron loss by forming the waveform unevenness on the free solidified surface of the Fe-based amorphous alloy ribbon. The waveform unevenness is also referred to as chatter marks and so forth and is generated due to oscillations from paddles when manufacturing (casting) the Fe-based amorphous alloy ribbon (for example, see paragraph 0008 in International Patent Application Publication No. 2012/102379). With respect to the technique of forming the waveform unevenness to thereby reduce the iron loss, the waveform unevenness is formed on the free solidified surface of the Fe-based amorphous alloy ribbon intentionally by adjusting manufacturing conditions of the Fe-based amorphous alloy ribbon.

While the aforementioned technique is to reduce the iron loss by forming the waveform unevenness, Japanese Unexamined Patent Application Publication No. S61-029103 and International Patent Application Publication No. 2011/030907, for example, disclose a technique of a conventional laser processing for an attempt to obtain an effect, similar to the effect obtained by forming the waveform unevenness (effect of reducing the iron loss, etc.), by applying a laser processing on a free solidified surface in place of forming the waveform unevenness. In this technique of the conventional laser processing, laser radiation marks are formed with a narrowed line space in order to form shapes similar to the shape of the waveform unevenness (for example, with a line space of 5 mm as disclosed in examples in Japanese Unexamined Patent Application Publication No. S61-029103 and International Patent Application Publication No. 2011/030907) in other words, with a relatively high number density of the laser radiation marks.

Conventionally, a disadvantage of increasing the number density of the laser radiation marks (that is, an increase in the exciting power) have not been recognized since the exciting power has been measured under the condition that the magnetic flux density is 1.3 T. However, as mentioned earlier, the inventor of the present disclosure and others have found that the exciting power measured under the condition that the magnetic flux density is 1.45 T increases in a case in which the number density of the laser radiation marks is increased, and that an increase in the exciting power measured under the condition that the magnetic flux density is 1.45 T can be inhibited by reducing the number density of the laser radiation marks.

The Fe-based amorphous alloy ribbon of the present disclosure is based on this finding.

Accordingly, the Fe-based amorphous alloy ribbon of the present disclosure shares a common aspect with the techniques disclosed in Japanese Unexamined Patent Application Publication No. S61-029103 and International Patent Application Publication No. 2011/030907 in that the laser radiation marks are formed on a surface of the ribbon, but is completely different from the techniques disclosed in Japanese Unexamined Patent Application Publication No. S61-029103 and International Patent Application Publication No. 2011/030907 in that the Fe-based amorphous alloy ribbon of the present disclosure tries to inhibit an increase in the exciting power measured under the condition that the magnetic flux density is 1.45 T by decreasing the number density of the laser radiation marks.

The Fe-based amorphous alloy ribbon of the present disclosure and its favorable aspects will be explained hereinafter in more detail.

The Fe-based amorphous alloy ribbon of the present disclosure is an Fe-based amorphous alloy ribbon including a free solidified surface and a roll contacting surface.

The Fe-based amorphous alloy ribbon including the free solidified surface and the roll contacting surface is a ribbon manufactured (casted) by a single-roll method. The roll contacting surface is a surface contacting a chill roll and rapidly solidified during casting. The free solidified surface is a surface opposite the roll contacting surface (that is, the surface exposed to the atmosphere during the casting). As regards the single-roll method, publicly-known documents such as International Patent Application Publication No. 2012/102379 are available for reference.

The Fe-based amorphous alloy ribbon of the present disclosure may be a ribbon uncut after the casting (for example, a rolled ribbon formed by winding into a roll after the casting), or may be a ribbon piece cut out into a desired size after the casting.

[Laser Radiation Marks and Dotted Line Laser Radiation Traces]

The Fe-based amorphous alloy ribbon of the present disclosure includes the dotted line laser radiation traces each formed of the laser radiation marks and arranged on at least one surface of the ribbon.

Each laser radiation mark of the laser radiation marks forming the dotted line laser radiation traces is only required to be a mark that is left by an imposition of energy by the laser processing (that is, laser radiation). There are no particular requirements as to a shape of the laser radiation mark (in planar view shape and in sectional view shape).

It is only required that each laser radiation mark is a mark that is left by the imposition of energy by the laser radiation to obtain the effect of reducing the iron loss by the laser radiation.

The planar-view shape of the laser radiation mark may be any shape, such as a crown-like shape, a donut shape, and a flat shape.

In view of weather resistance (rust prevention) of the laser radiation marks on the Fe-based amorphous alloy ribbon and improvement in lamination factor of the Fe-based amorphous alloy ribbon, the planar-view of the laser radiation mark is preferably the donut shape or the flat shape, and more preferably the flat shape. The flat shape can reduce spaces between the ribbons when the ribbons are layered to form the iron core and thereby improve a density of the ribbon in the iron core.

In the Fe-based amorphous alloy ribbon of the present disclosure, when the space between two of the center lines of the dotted line radiation traces arranged in the casting direction and adjacent to one another at the central part of the ribbon in the width direction is the line space, the line space is preferably from 10 mm to 60 mm.

The width direction is a direction orthogonal to the casting direction of the Fe-based amorphous alloy ribbon.

In a case in which the dotted line laser radiation traces are formed on both of the free solidified surface and the roll contacting surface of the ribbon, the line space is measured with respect to the dotted line laser radiation traces on the both surfaces by transparently observing the ribbon. For example, if the dotted line laser radiation traces are alternately formed on the both surfaces along the casting direction of the ribbon, the "adjacent two of the dotted line laser radiation traces" include the dotted line laser radiation traces on one surface and the other surface of the free solidified surface and the roll contacting surface, which are adjacent to one another along the casting direction.

As a result of having the line space of 10 mm or more, an increase in the exciting power measured under the condition that the magnetic flux density is 1.45 T can be more inhibited than in a case where the line space is less than 10 mm.

As a result of having the line space of 60 mm or less, the effect of reducing the iron loss measured under the condition that the magnetic flux density is 1.45 T is superior to that in a case where the line space exceeds 60 mm.

The line space is more favorably from 10 mm to 50 mm, yet more favorably from 10 mm to 40 mm, and even more favorably from 10 mm to 30 mm.

The directions of the dotted line laser radiation traces are favorably, but not limited to be, approximately parallel to one another. The line space is favorably from 10 mm to 60 mm at the central part of the ribbon in the width direction. The directions of the dotted line laser radiation traces may be, but do not have to be, parallel to one another.

On the Fe-based amorphous alloy ribbon, the "central part of the ribbon in the width direction" may be a portion of the ribbon that has a certain range of width from the midpoint to the both ends of the ribbon in the width direction. For example, the central part may be an area that has "the certain range of width" from the midpoint to the both ends of the ribbon in the width direction equal to a quarter of the total width of the ribbon. It is particularly favorable that the central part is an area that has "the certain range of width" equal to a half of the total width of the ribbon.

In one embodiment of the present disclosure, the dotted line laser radiation traces of the Fe-based amorphous alloy ribbon may be arranged with a positional relationship in which each dotted line laser radiation trace is not arranged parallel to the width direction of the ribbon, which is orthogonal to the casting direction of the Fe-based amorphous alloy ribbon.

In other words, each dotted line laser radiation trace may be arranged at an angle of 10 degrees or more relative to the width direction of the ribbon, so that each dotted line laser radiation trace may intersect with the casting direction of the ribbon at an acute angle or at an obtuse angle.

In another embodiment of the present disclosure, the dotted line laser radiation traces of the Fe-based amorphous alloy ribbon are preferably arranged approximately parallel to a direction that is orthogonal to the casting direction and a thickness direction of the Fe-based amorphous alloy ribbon. What is meant by this arrangement is that each dotted line laser radiation trace is arranged at an angle of less than 10 degrees relative to the direction orthogonal to the casting direction and the thickness direction of the Fe-based amorphous alloy ribbon.

Nevertheless, the positional relationship of the dotted line laser radiation traces relative to one another is not limited to being approximately parallel.

In one embodiment of the Fe-based amorphous alloy ribbon of the present disclosure, each dotted line laser radiation trace is preferably arranged approximately parallel to the width direction of the Fe-based amorphous alloy ribbon. What is meant by this arrangement is that each dotted line laser radiation trace is arranged at an angle of less than 10 degrees relative to the width direction of the Fe-based amorphous alloy ribbon.

Nevertheless, the positional relationship of the dotted line laser radiation traces relative to one another is not limited to being approximately parallel.

As mentioned above, each dotted line laser radiation trace does not have to be parallel to the direction orthogonal to the casting direction of the Fe-based amorphous alloy ribbon, and may be arranged at an inclined angle exceeding 10 degrees relative to the direction orthogonal to the casting direction of the Fe-based amorphous alloy ribbon. It is to be construed that each dotted line laser radiation trace extends orthogonally to the casting direction of the Fe-based amorphous alloy ribbon even with a positional arrangement with an inclined angle exceeding 10 degrees. The inclined angle is preferably less than 45 degrees, more preferably less than 40 degrees, yet more preferably less than 30 degrees, even more preferably less than 20 degrees, and most preferably less than 10 degrees. Each dotted line laser radiation trace may extend in a direction that crosses the casting direction of the ribbon.

The Fe-based amorphous alloy ribbon in one mode of the present disclosure may include one set of trace alignments in the width direction of the ribbon. The one set of trace alignments includes alignments of the dotted line laser radiation traces at regular intervals along the casting direction of the ribbon. The Fe-based amorphous alloy ribbon in another mode of the present disclosure may include two or more sets of the trace alignments in the width direction of the ribbon.

More specifically, in the width direction orthogonal to the casting direction of the ribbon, the Fe-based amorphous alloy ribbon of the present disclosure may include the dotted line laser radiation traces arranged along the casting direction of the Fe-based amorphous alloy ribbon (1) in a first mode in which one set of the dotted line laser radiation traces (hereinafter referred to as single set of trace alignments) is included in "the central part of the ribbon in the width direction"; or (2) in a second mode in which two or more sets of the dotted line laser radiation traces (hereinafter referred to as multiple sets of trace alignments) are included in "the central part of the ribbon in the width direction".

Hereinafter, the dotted line laser radiation traces arranged along the casting direction of the Fe-based amorphous alloy ribbon may also be called a "set of radiation traces".

The multiple sets of trace alignments in the second mode include two or more sets of radiation traces arranged in the width direction of the ribbon. A position of each dotted line laser radiation trace in each set of radiation traces does not have to align on the same line with another dotted line laser radiation trace in another set of radiation traces along the with direction. Each dotted line laser radiation trace in each set of radiation traces may be misaligned with another dotted line laser radiation trace in another set of radiation traces in the casting direction. For example, in a case in which two sets of radiation traces are present along the width direction of the ribbon, these two sets of radiation traces are parted by an unmarked area in the central part of the ribbon in the width direction; the dotted line laser radiation traces aligned in one set of radiation traces and the dotted line laser radiation traces aligned in another set of radiation traces may be positioned alternately at regular intervals along the casting direction of the ribbon.

The line space of the present disclosure is a value calculated as below.

In a case in which, as mentioned in the above (1) as the first mode, the ribbon includes one set of the dotted line laser radiation traces arranged along the casting direction of the ribbon in "the central part of the ribbon in the width direction" as the "single set of trace alignments", randomly selected five line spaces in the single set of trace alignments may be measured, and an average of the five values may be determined as an average value of the line space. In this case, it is favorable that the dotted line laser radiation traces included in the single set of trace alignments are arranged at regular intervals, however, they may be arranged at random intervals.

In a case in which, as mentioned in the above (2) as the second mode, the ribbon includes two or more sets of the dotted line laser radiation traces arranged along the casting direction of the ribbon in "the central part of the ribbon in the width direction" as the "multiple sets of trace alignments", an average value of the line spaces may be calculated for each set of radiation traces in the multiple sets of the trace alignments first as explained in the above first mode, and the average values obtained may be further averaged to determine an average value of the line space. In this case, it is favorable that the dotted line laser radiation traces included in each "set of radiation traces" are arranged at regular intervals, however, they may be arranged at random intervals.

In the Fe-based amorphous alloy ribbon of the present disclosure, when the spaces between adjacent two of the center points of the laser radiation marks is the spot space, the spot space is from 0.10 mm to 0.50 mm. Therefore, there is no configuration in which the laser radiation marks are formed continuously with the spot spaces of less than 0.10 mm.

Compared with the spot space of less than 0.10 mm, the spot space of 0.10 mm or more can help inhibit an increase in the exciting power measured under the condition that the magnetic flux density is 1.45 T (see FIG. 6).

In a case with the spot space of 0.50 mm or less, the effect of reducing the iron loss measured under the condition that the magnetic flux density is 1.45 T is superior to that with the spot space exceeding 0.50 mm.

The spot space is preferably from 0.15 mm to 0.40 mm, and more preferably from 0.20 mm to 0.40 mm.

As mentioned above, the Fe-based amorphous alloy ribbon of the present disclosure aims to inhibit an increase in the exciting power measured under the condition that the magnetic flux density is 1.45 T by reducing the number density of the laser radiation marks that forms the dotted line laser radiation trace compared to conventional techniques.

In the Fe-based amorphous alloy ribbon of the present disclosure, when the line space is d1 (mm) and the spot space is d2 (mm), the number density D of the laser radiation marks is determined by the following formula.

$$D=(1/d1)\times(1/d2)$$

The number density D is a value obtained from the line space and the spot space, and represents a density of the laser radiation marks that are being formed. In other words, within a unit area ($mm^2$) having a line space and a spot space, the number density (D) that satisfies $d1\times d2\times D=1$ is in a range from 0.05 marks/$mm^2$ to 0.50 marks/$mm^2$.

As a result of setting the number density D of the laser radiation marks to an appropriate value (a value smaller than conventional techniques), an increase in the exciting power measured under the condition that the magnetic flux density is 1.45 T can be inhibited.

The number density D of the laser radiation marks that form the dotted line laser radiation trace is from 0.05 marks/$mm^2$ to 0.50 marks/$mm^2$.

The number density D of the laser radiation marks that form the dotted line laser radiation trace is more preferably from 0.10 marks/$mm^2$ to 0.50 marks/$mm^2$.

If there is a plurality of the dotted line laser radiation traces in the present disclosure, then the number density D can be calculated as below depending on the case.

In a case in which, as mentioned in the above (1) as the first mode, the ribbon includes one set of the dotted line laser radiation traces arranged along the casting direction of the ribbon in "the central part of the ribbon in the width direction" as the "single set of trace alignments", randomly selected five adjacent pairs of the dotted line laser radiation traces in the single set of trace alignments are measured to obtain their line spaces and spot spaces; average values for the line space and the spot space are calculated; and the number density D is obtained with the above formula by using the average values for the line space and the spot space. The effect of the present disclosure can be exerted as a consequence that the obtained number density D is from 0.05 marks/$mm^2$ to 0.50 marks/$mm^2$ In a case in which, as mentioned in the above (2) as the second mode, the ribbon includes two or more sets of the dotted line laser radiation traces arranged along the casting direction of the ribbon in "the central part of the ribbon in the width direction" as the "multiple sets of trace alignments", the number density D is obtained for each "set of the radiation traces" in the multiple sets of trace alignments in the same manner as mentioned before. The effect of the present disclosure is exerted as a result of the number density D of at least one of the multiple sets of radiation traces in the multiple sets of trace alignments being in a range from 0.05 marks/$mm^2$ to 0.50 marks/$mm^2$. And in order to further exert the effect of the present disclosure, it is preferable that the average value of the obtained number density D is preferably in a range from 0.05 marks/$mm^2$ to 0.50 marks/$mm^2$. It is more preferable that the number densities D of all of "the sets of radiation traces" in "the multiple sets of trace alignments" are in a range from 0.05 marks/$mm^2$ to 0.50 marks/$mm^2$.

The "casting direction" corresponds to a circumferential direction of the chill roll in the casting operation of the Fe-based amorphous alloy ribbon; in other words, it corresponds to a longitudinal direction of the casted Fe-based amorphous alloy ribbon before undergoing the cutting operation.

The "casting direction" can also be confirmed on the cut ribbon piece by observing the free solidified surface and/or the roll contacting surface of the cut ribbon piece. For example, a thin line is observed on the free solidified surface and/or the roll contacting surface of the ribbon piece along the casting direction. A direction orthogonal to the casting direction is the width direction.

Preferably, a proportion of a length of the dotted line laser radiation trace to a total width of the Fe-based amorphous alloy ribbon is in a range from 10% to 50% each in both directions from a midpoint of the Fe-based amorphous alloy ribbon towards ends of the Fe-based amorphous alloy ribbon in the width direction. In this case, the entire length of the Fe-based amorphous alloy ribbon in the width direction is considered 100%.

In a case in which the dotted line laser radiation trace is inclined with respect to the width direction of the ribbon, the inclined trace per se should not be measured as the length of the dotted line laser radiation trace; the length of the inclined trace with respect to an area it is formed is converted into a length with respect to the width direction of the ribbon to obtain the length of the dotted line laser radiation trace.

When the above proportion of the length of the dotted line laser radiation trace is 50%, it means that the dotted line laser radiation trace reaches one end and an another end of the Fe-based amorphous alloy ribbon starting from the midpoint of the ribbon in the width direction. The dotted line laser radiation trace "reaching the one end and the another end of the ribbon starting from the midpoint of the ribbon in the width direction" means that spaces between furthermost laser radiation marks of the dotted line laser radiation trace and corresponding ends of the ribbon are equal to or less than the spot space of the laser radiation marks.

For example, when the dotted line laser radiation trace is arranged parallel to the width direction of the Fe-based amorphous alloy ribbon, the entire length of the Fe-based amorphous alloy ribbon in the direction along which the dotted line laser radiation trace is formed corresponds to the entire length of the Fe-based amorphous alloy ribbon.

When the above proportion of the length of the dotted line laser radiation trace is 10%, it means that the dotted line laser radiation trace occupies 10% of the length of the ribbon starting from the midpoint of the ribbon towards each end of the ribbon along the width direction. This means that the length of the dotted line laser radiation trace occupies 20% of the total width of the ribbon in the central part of the width. In other words, the dotted line laser radiation trace is formed on the ribbon by leaving 40% of the length of the ribbon without being laser-marked from the both ends of the ribbon It is further preferable that the dotted line laser radiation trace is formed on the ribbon at least inside an area of central six-eights of eight equal sections of the ribbon divided along the width direction, excluding two-eights on both ends of the ribbon.

[Roughness of Free Solidified Surface (Maximum Cross-Sectional Height Rt)]

For example, as disclosed in International Patent Application Publication No. 2012/102379, iron loss has been conventionally reduced by forming the waveform unevenness on the free solidified surface.

However, the inventor of the present disclosure and others have considered and found that the waveform unevenness may cause an increase in the exciting power measured under the condition that the magnetic flux density is 1.45 T.

Accordingly, it is preferable that the waveform unevenness is reduced as much as possible with the object of inhibiting an increase in the exciting power measured under the condition that the magnetic flux density is 1.45 T.

Specifically, a maximum cross-sectional height Rt on the free solidified surface, except for a portion where the dotted line laser radiation traces are formed, is 3.0 μm or less. What is meant by the maximum cross-sectional height Rt being 3.0 μm or less is that there are no waveform unevenness or reduced waveform unevenness on the free solidified surface.

In the present disclosure, for a portion where the dotted line laser radiation traces are not formed, the maximum cross-sectional height Rt on the free solidified surface is measured with an evaluation length of 4.0 mm, a cutoff value of 0.8 mm, and a type of cutoff being 2RC (phase compensation) as complying with JIS B 0601: 2001. A direction of the evaluation length is set to be the casting direction of the Fe-based amorphous alloy ribbon. More specifically, the aforementioned measurement of the maximum cross-sectional height Rt with the evaluation length of 4.0 mm is performed by continuously measuring the maximum cross-sectional height Rt five times with the cutoff value of 0.8 mm.

The maximum cross-sectional height Rt on the free solidified surface for a portion where the dotted line laser radiation traces are not formed is more preferably 2.5 μm or less.

Although there is no particular lower limit of the maximum cross-sectional height Rt, the lower limit of the maximum cross-sectional height Rt is preferably 0.8 μm, and more preferably 1.0 μm in view of the competence in manufacturing the Fe-based amorphous alloy ribbon.

[Chemical Composition]

There is no limitations as to the chemical compositions of the Fe-based amorphous alloy ribbon of the present disclosure as long as the ribbon has the chemical composition of the Fe-based amorphous alloy (that is, the chemical composition with a main component being Fe (iron)). Nevertheless, with the object of further obtaining effects of the Fe-based amorphous alloy ribbon of the present disclosure, the chemical composition of the Fe-based amorphous alloy ribbon of the present disclosure is preferably the following chemical composition A.

The chemical composition A, which is the preferable chemical composition, contains Fe, Si, B, and an impurity. When the total content of Fe, Si, and B is 100 atomic %, a content of Fe is 78 atomic % or more; a content of B is 10 atomic % or more; a total content of B and Si is from 17 atomic % to 22 atomic %.

The chemical composition A will be explained in detail hereinafter.

In the chemical composition A, the content of Fe is 78 atomic % or more.

Fe (iron) is one of the transition metals that have the largest magnetic moment even in an amorphous structure. Fe predominantly provides magnetic property in an Fe—Si—B amorphous alloy.

In a case in which the content of Fe is 78 atomic % or more, a saturated magnetic flux density (Bs) of the Fe-based amorphous alloy ribbon can be increased (for example, Bs of about 1.6 T can be achieved). Furthermore, it facilitates achieving a preferable magnetic flux density of B 0.08 (1.52 T or more).

The content of Fe is preferably 80 atomic % or more, more preferably 80.5 atomic % or more, yet more preferably 81.0 atomic % or more. Furthermore, the content of Fe is preferably 82.5 atomic % or less, and more preferably 82.0 atomic % or less.

In the chemical composition A, the content of B is 10 atomic % or more.

B (boron) is an element that contributes in amorphous formation. In a case in which the content of B is 10 atomic % or more, an amorphous forming ability is improved further.

In a case in which the content of B is 10 atomic % or more, the magnetic domain tends to be oriented in the casting direction, which enlarges the width of the magnetic domain and thereby facilitates improvement of the magnetic flux density (B0.08).

The content of B is preferably 11 atomic % or more, more preferably 12 atomic % or more, and yet more preferably 13 atomic % or more.

An upper limit of the content of B is preferably 16 atomic %, although it depends on the total content of B and Si, which will be mentioned later.

In the chemical composition A, the total content of B and Si is from 17 atomic % to 22 atomic %.

Si (silicon) is an element that segregates on a surface in a molten state and exerts an effect of preventing oxidation of the molten metal. In addition, Si serves as an auxiliary in amorphous formation with an effect of increasing a glass transition temperature and is an element that helps forming an amorphous phase that is more thermally stable.

In a case in which the total content of B and Si is 17 atomic % or more, the aforementioned effects of Si can be effectively exhibited.

In a case in which the total content of B and Si is 22 atomic % or less, a large amount of Fe that predominantly provides magnetic property can be obtained, and which is advantageous in improving the saturation magnetic flux density Bs and the magnetic flux density B0.08.

The content of Si is preferably 2.0 atomic % or more, more preferably 2.4 atomic % or more, and yet more preferably 3.5 atomic % or more.

An upper limit of the content of Si is preferably 6.0 atomic %, although it depends on the total content of B and Si.

With the object of further improving the iron loss and the exciting power which will be explained later, a more preferable chemical composition of the Fe-based amorphous alloy ribbon among the chemical composition A includes Fe, Si, B, and an impurity; the content of Fe is 80 atomic % or more, the content of B is 12 atomic % or more, and the total content of B and Si is from 17 atomic % to 20 atomic % when the total content of Fe, Si, and B is 100 atomic %.

The chemical composition A includes an impurity.

In this case, the chemical composition A may include one kind of impurity or two or more kinds of impurities.

Examples of the impurity include any elements other than Fe, Si, and B, specifically, for example, C, Ni, Co, Mn, O, S, P, Al, Ge, Ga, Be, Ti, Zr, Hf, V, Nb, Ta, Cr, Mo, and rare earth elements.

The chemical composition can contain 1.5 mass % or less of these elements in total with respect to the total mass of Fe, Si, and B. The total content of these elements is preferably 1.0 mass % or less, more preferably 0.8 mass % or less, and yet more preferably 0.75 mass % or less with respect to the total mass of Fe, Si, and B. These elements may be added to the chemical composition within these ranges.

[Thickness]

A thickness of the Fe-based amorphous alloy ribbon of the present disclosure is not limited to a particular size; however, the thickness is preferably 18 μm to 35 μm.

Having the thickness of 18 μm or more is advantageous in inhibiting undulations of the Fe-based amorphous alloy ribbon and thus in improving the lamination factor of the Fe-based amorphous alloy ribbon.

Having the thickness of 35 μm or less is advantageous in inhibiting embrittlement of the Fe-based amorphous alloy ribbon, and in terms of magnetic saturability.

The thickness of the Fe-based amorphous alloy ribbon is more preferably from 20 μm to 30 μm.

[Iron Loss]

As mentioned above, the Fe-based amorphous alloy ribbon of the present disclosure exhibits a reduced iron loss under the condition that the frequency is 60 Hz and the magnetic flux density is 1.45 T by segmentation of the magnetic domain by the laser processing (formation of the laser radiation marks).

The iron loss under the condition that the frequency is 60 Hz and the magnetic flux density is 1.45 T is 0.150 W/kg or less, which is preferably 0.140 W/kg or less, and more preferably 0.130 W/kg or less.

Although there is no particular lower limit of the iron loss under the condition that the frequency is 60 Hz and the magnetic flux density is 1.45 T, the lower limit of the iron loss is preferably 0.050 W/kg in view of the competence in manufacturing the Fe-based amorphous alloy ribbon.

The Fe-based amorphous alloy ribbon of the present disclosure also exhibits a reduced iron loss CL under the condition that the frequency is 50 Hz and the magnetic flux density is 1.45 T. The Fe-based amorphous alloy ribbon of the present disclosure preferably exhibits the iron loss CL of 0.120 W/kg or less under the condition that the frequency is 50 Hz and the magnetic flux density is 1.45 T.

The Fe-based amorphous alloy ribbon of the present disclosure also exhibits a reduced iron loss under the condition that the frequency is 50 Hz and the magnetic flux density is 1.3 T, or under the condition that the frequency is 60 Hz and the magnetic flux density is 1.3 T. It is preferable that the iron loss is 0.08 W/kg or less under the condition that the frequency is 50 Hz and the magnetic flux density is 1.3 T, or that the iron loss is 0.11 W/kg or less under the condition that the frequency is 60 Hz and the magnetic flux density is 1.3 T.

The iron loss of the Fe-based amorphous alloy ribbon is measured in accordance with JIS C25 35: 2017 or JIS H7152: 1996.

[Exciting Power]

As mentioned above, the Fe-based amorphous alloy ribbon of the present disclosure inhibits an increase in the exciting power under the condition that the magnetic flux density is 1.45 T.

The exciting power under the condition that the frequency is 60 Hz and the magnetic flux density is 1.45 T is preferably 0.200 VA/kg or less, more preferably 0.170 VA/kg or less, and yet more preferably 0.165 VA/kg or less.

Although there is no particular lower limit of the exciting power under the condition that the frequency is 60 Hz and the magnetic flux density is 1.45 T, the lower limit of the exciting power is preferably 0.100 VA/kg in view of the competence in manufacturing the Fe-based amorphous alloy ribbon.

[Magnetic Flux Density B0.08]

As mentioned above, the Fe-based amorphous alloy ribbon of the present disclosure inhibits an increase in the exciting power under the condition that the magnetic flux density is 1.45 T. Thus, a decrease in the magnetic flux density B0.08 associated with the increase in the exciting power is also inhibited, which consequently enables the magnetic flux density B0.08 to be maintained at a high level.

The magnetic flux density B0.08 of the Fe-based amorphous alloy ribbon of the present disclosure under the condition that the frequency is 60 Hz and the magnetic field is 8 A/m is preferably 1.52 T or more.

Although there is no particular upper limit of the magnetic flux density B0.08 under the condition that the frequency is 60 Hz and the magnetic field is 8 A/m, the upper limit is preferably 1.62 T.

[Ratio <Operating Magnetic Flux Density Bm/Saturation Magnetic Flux Density Bs>]

As mentioned above, the Fe-based amorphous alloy ribbon of the present disclosure can reduce the iron loss and the exciting power to low levels under the condition that the magnetic flux density is 1.45 T, which is higher than the magnetic flux density of 1.3 T in the conventional condition.

Thus, the Fe-based amorphous alloy ribbon of the present disclosure can still reduce the iron loss and the exciting power in a case in which the ribbon is used with a ratio <operating magnetic flux density Bm/saturation magnetic flux density Bs>(hereinafter, also referred to as "Bm/Bs ratio") having the operating magnetic flux density Bm that is higher than that in the conventional condition.

Regarding this matter, an Fe-based amorphous alloy ribbon in one conventional example was used under the condition that the saturation magnetic flux density Bs was 1.56 T and the operating magnetic flux density Bm was 1.35 T (that is, Bm/Bs ratio=0.87) (for example, see IEEE TRANSACTIONS ON MAGNETICS, Vol: 44, Issue: 11, Nov. 2008, pp. 4104-4106 (particularly p. 4106)).

Meanwhile, Bs of the Fe-based amorphous alloy ribbon of the present disclosure having, for example, a chemical composition ($Fe_{82}Si_4B_{14}$), which will be explained later, is 1.63 T. Bs is determined substantially unambiguously depending on the chemical composition. The Fe-based amorphous alloy ribbon of the present disclosure in the above example can be used at Bm of 1.43 T or more (preferably from 1.45 T to 1.50 T). The Bm/Bs ratio is 0.88 with Bm being 1.43 T. The Bm/Bs ratio is 0.92 with Bm being 1.50 T.

Accordingly, it is particularly preferable that the Fe-based amorphous alloy ribbon of the present disclosure is used when the operating magnetic flux density Bm satisfies to yield the Bm/Bs ratio that ranges from 0.88 to 0.94 (preferably from 0.89 to 0.92).

The Fe-based amorphous alloy ribbon of the present disclosure can inhibit increases in the iron loss and the exciting power even when the operating magnetic flux density Bm satisfies to yield the Bm/Bs ratio that ranges from 0.88 to 0.94 (preferably from 0.89 to 0.92).

[Method of Manufacturing Fe-based Amorphous Alloy Ribbon (Method X)]

The aforementioned Fe-based amorphous alloy ribbon of the present disclosure can be manufactured through the following method X.

Method X includes the following processes: a process (hereinafter, also referred to as "material preparation process") of preparing a material ribbon that is made of an Fe-based amorphous alloy and has the free solidified surface and the roll contacting surface; and a process (hereinafter, also referred to as "laser processing process") of obtaining the Fe-based amorphous alloy ribbon having the dotted line laser radiation traces by arranging the dotted line laser radiation traces formed of the laser radiation marks on at least one surface among the free solidified surface and the roll contacting surface of the material ribbon.

The line space is the space between two of the center lines of the dotted line laser radiation traces arranged in the casting direction and adjacent to one another at the central part of the ribbon in the width direction orthogonal to the casting direction. And the spot space is the space between adjacent two of the center points of the laser radiation marks that form each dotted line laser radiation trace. The spot space is 0.10 mm to 0.50 mm. In a case in which the line space is d1 (mm), the spot space is d2 (mm), and the number density D of the laser radiation marks is determined by the following formula: $D=(1/d1)\times(1/d2)$, the number density D of the laser radiation marks is from 0.05 marks/mm$^2$ to 0.50 marks/mm$^2$.

The method X may include a process other than the material preparation process and the laser processing process as necessary.

[Material Preparation Process]

The material preparation process in the method X is for preparing the material ribbon that includes the free solidified surface and the roll contacting surface.

The material ribbon mentioned here may be a ribbon that is uncut after casting (for example, a rolled ribbon formed by winding into a roll after the casting), or a ribbon piece that is cut into a desired size after the casting. The material ribbon is the Fe-based amorphous alloy ribbon of the present disclosure before the formation of the laser radiation traces, so to speak.

The free solidified surface and the roll contacting surface of the material ribbon respectively used synonymously with the free solidified surface and the roll contacting surface of the Fe-based amorphous alloy ribbon of the present disclosure.

Preferable aspects of the material ribbon (for example, preferable chemical composition and preferable Rt) are the same as the preferable aspects of the Fe-based amorphous alloy ribbon of the present disclosure except for the presence of the laser radiation traces.

The material preparation process may be a process of simply preparing a pre-casted (that is, already finished) material ribbon for the laser processing process, or may be a process of casting a new material ribbon.

The material preparation process may be a process of performing at least one of the casting of the material ribbon or the cutting of the ribbon piece from the material ribbon.

[Laser Processing Process]

The laser processing process in the method X is for forming the laser radiation marks (specifically, the dotted line laser radiation traces formed of the laser radiation marks) on at least one surface among the free solidified surface and the roll contacting surface of the material ribbon by the laser processing (that is, by laser radiation).

Preferable aspects of the laser radiation marks and the dotted line laser radiation traces formed by the laser processing process (for example, preferable line space, preferable spot space, and preferable number density of the laser radiation marks) are the same as the preferable aspects of the laser radiation marks and the dotted line laser radiation traces of the Fe-based amorphous alloy ribbon of the present disclosure.

As mentioned above, it is only required that each laser radiation mark is a mark that is left by the imposition of energy by the laser radiation to obtain the effect of reducing the iron loss by the laser radiation.

Accordingly, there is no particular limits as to the conditions of the laser used in the laser processing process. Preferable conditions are as mentioned below.

Diameters and depths of the recesses can be controlled by controlling the energy of irradiation by laser light with respect to the thickness of the Fe-based amorphous alloy ribbon.

An output power of the laser (hereinafter also referred to as "laser output power") to form the laser radiation traces in the laser processing process is preferably from 0.4 mJ to 2.5 mJ, more preferably from 0.6 mJ to 2.5 mJ, yet more preferably from 0.8 mJ to 2.5 mJ, yet more preferably from 1.0 mJ to 2.0 mJ, and yet more preferably from 1.3 mJ to 1.8 mJ.

A diameter of laser beam (hereinafter also referred to as "spot diameter") is preferably from 50 μm to 200 μm.

In a case in which a value obtained by dividing the laser output power by a spot area is defined as an energy density of the laser, the energy density is preferably from 0.01 J/mm$^2$ to 1.50 J/mm$^2$, more preferably from 0.02 J/mm$^2$ to 1.30 J/mm$^2$, and yet more preferably from 0.03 J/mm$^2$ to 1.02 J/mm$^2$.

A pulse width of the laser is preferably 50 nsec or more, and more preferably 100 nsec or more. By setting the pulse width within the aforementioned ranges, the magnetic characteristics of the ribbon piece having the laser radiation traces formed thereon, such as the iron loss, can be effectively improved.

The pulse width is a time duration of the laser radiation. If the pulse width is small, then the time duration of the laser radiation is short. In other words, a total energy of the radiating laser light is represented by a product of the energy per unit time and the pulse width.

In the laser processing, the ribbon is irradiated by a pulse laser light scanning the ribbon in the width direction to form the recesses.

Examples of suitable laser light sources can be a YAG laser, a $CO_2$ gas laser, and a fiber laser. Among these laser light sources, the fiber laser is preferable in that it can stably radiate a high output power and high frequency pulse laser light for long hours. In the fiber laser, a laser light coupled into a fiber oscillates on the principle of fiber Bragg grating (FBG) due to diffraction gratings provided on both ends of the fiber. The laser light of the fiber laser is excited within a thin fiber; therefore, there is no problems of thermal lens effect, which is induced by temperature gradients occurred inside a crystal and deteriorates the beam quality. Furthermore, a fiber core of the fiber laser is as thin as several microns; thus, even with a high output power, a resulting laser light can have a high energy density with a narrowed beam diameter in addition to providing a single-mode emission. Moreover, the fiber laser has a long focal depth; therefore, it can accurately form the recesses in lines on a wide ribbon having a width of 200 mm or more. The pulse width of the fiber laser is generally in a range approximately from microseconds to picoseconds.

A wave length of the laser light is approximately from 250 nm to 1,100 nm depending on the laser light source. Nevertheless, it is preferably from 900 nm to 1,100 nm for sufficient absorption of the laser light in the alloy ribbon.

The beam diameter of the laser light is preferably 10 μm or more, more preferably 30 μm or more, and yet more preferably 50 μm or more. The beam diameter of the laser light is preferably 500 μm or less, more preferably 400 μm or less, and yet more preferably 300 μm or less.

The laser processing process may be a process for applying the laser processing on the material ribbon after the casting by the single-roll method and before being wound into a roll, or may be a process for applying the laser processing on the material ribbon that is unwound from the wound material ribbon (the rolled ribbon), or may be a process for applying the laser processing on the ribbon piece that is cut out from the material ribbon unwound from the wound material ribbon (the rolled ribbon).

In a case in which the laser processing process is a process for applying the laser processing on the material ribbon after the casting by the single-roll method and before being wound into a roll, the method X is performed with a system, on which a laser processing device is arranged between the chill roll and a winding roll for example.

Examples of the Fe-based amorphous alloy ribbon suitable for the transformer of the present disclosure will be explained hereinafter.

[Example 101]

[Manufacturing of Material Ribbon (Fe-Based Amorphous Alloy Ribbon Before Laser Processing)]

The material ribbon (that is, the Fe-based amorphous alloy ribbon before laser processing) having a chemical composition of $Fe_{82}Si_4B_{14}$, a thickness of 25 μm, and a width of 210 mm was manufactured by the single-roll method. The "chemical composition of $Fe_{82}Si_4B_{14}$" means that it contains Fe, Si, B, and an impurity, and that when the total content of Fe, Si, and B is 100 atomic %, the content of Fe is 82 atomic %, the content of B is 14 atomic %, and the content of Si is 4 atomic %.

Hereinafter, the manufacturing of the material ribbon will be explained in detail.

To manufacture the material ribbon, molten metal that includes chemical composition of $Fe_{82}Si_4B_{14}$ was maintained at 1,300° C., and then this molten metal was ejected from a slit nozzle to a surface of the chill roll rotating about a shaft. The ejected molten metal was rapidly solidified on the surface of the chill roll, and thereby the material ribbon was obtained. In this process, an atmosphere on the surface of the chill roll directly below the slit nozzle where a molten metal reservoir was formed was a non-oxidizing gas atmosphere. A slit of the slit nozzle was 210 mm in length and 0.6 mm in width. The chill roll was made of Cu-based alloy. A peripheral speed of the chill roll was 27 m/s. An ejection pressure of the molten metal and a nozzle gap (a gap between the tip of the slit nozzle and the surface of the chill roll) were adjusted such that the maximum cross-sectional height Rt on the free solidified surface of the manufactured material ribbon (more specifically, the maximum cross-sectional height Rt measured along the casting direction of the material ribbon) was 3.0 μm or less.

[Laser Processing]

To obtain a laser processed Fe-based amorphous alloy ribbon piece, sample piece was cut out from the material ribbon and the cut out sample piece underwent the laser processing.

Hereinafter, details of the laser processing will be explained.

Figure 4:
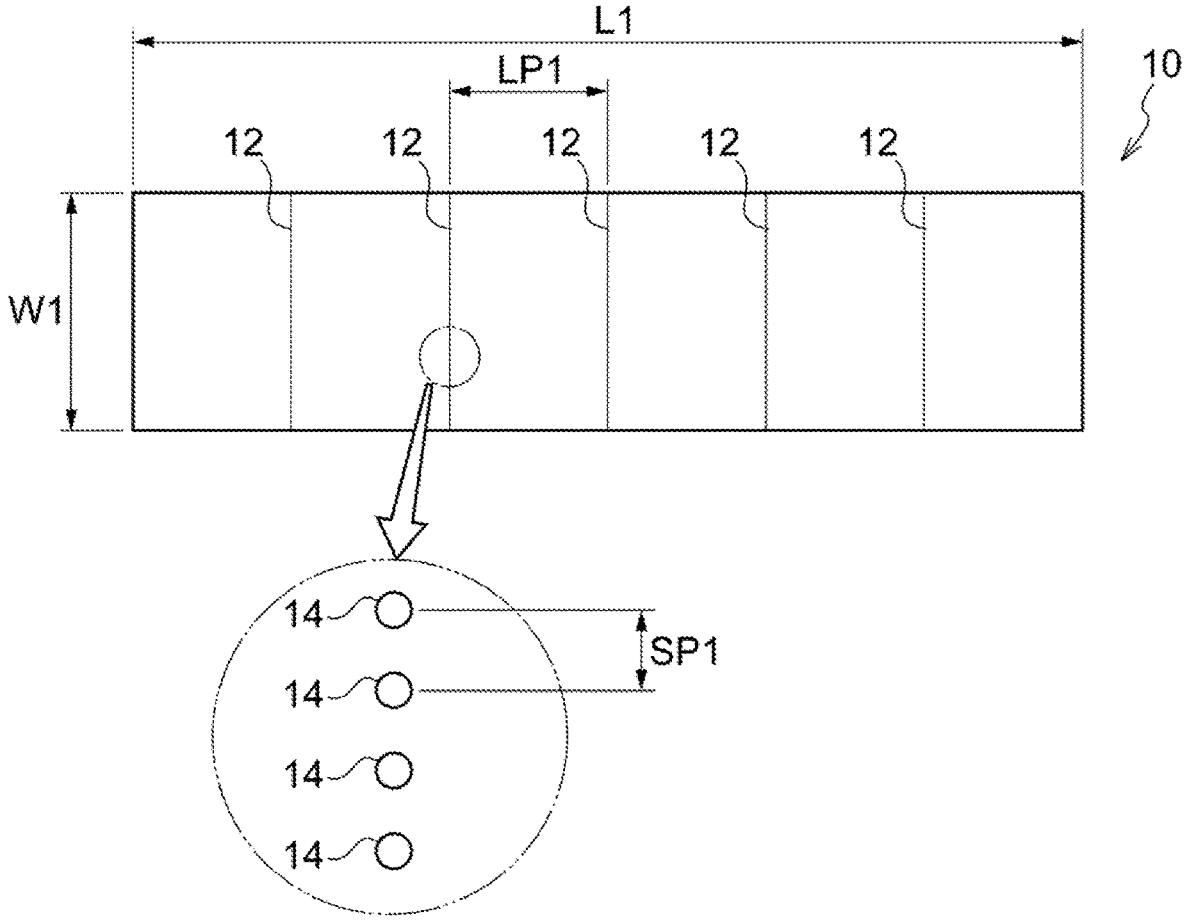
FIG. 4 is a schematic diagram showing one example of an Fe-based amorphous alloy ribbon of an embodiment of the present disclosure.

FIG. 4 is a schematic plan view for schematically showing the free solidified surface of the laser processed Fe-based amorphous alloy ribbon piece (ribbon 10).

The length L1 of the ribbon 10 shown in FIG. 4 (that is, a length of the sample piece cut out from the material ribbon) was 120 mm, and the width W1 of the ribbon 10 (that is, a width of the sample piece cut out from the material ribbon) was 25 mm. The sample piece was cut out such that a longitudinal direction of the sample piece coincided with the longitudinal direction of the material ribbon, and such that a width direction of the sample piece coincided with the width direction of the material ribbon. The longitudinal direction of the sample piece coincided with the casting direction of the material ribbon of the present disclosure; and the width direction of the sample piece coincided with the width direction of the material ribbon that is orthogonal to the casting direction.

The dotted line laser radiation traces 12 were formed by irradiating the free solidified surface of the cut sample piece by a pulse laser to thereby obtain the ribbon 10. One dotted line laser radiation trace 12 included laser radiation marks 14.

More specifically, the dotted line laser radiation trace 12 was formed on the free solidified surface of the sample piece (referring to the ribbon 10 before undergoing the laser processing; the same applies hereinafter) by forming the laser radiation marks 14 in one line parallel to the width direction of the sample piece. The dotted line laser radiation trace 12 was formed across the entire length of the sample piece along the width direction. In other words, the length of the dotted line laser radiation trace 12 along the width direction of the sample piece covered 100% of the total width of the sample piece. This corresponds to the fact that the proportion of the length of the dotted line laser radiation trace 12 to the total width of the Fe-based amorphous alloy ribbon is 50% each in both directions from the midpoint of the Fe-based amorphous ribbon towards the ends of the Fe-based amorphous alloy ribbon in the width direction. The dotted line laser radiation trace 12 was formed on the sample piece by arranging the laser radiation marks 14 in one line. A plurality of the dotted line laser radiation traces 12 were arranged on the sample piece at equal intervals along the casting direction. In each dotted line laser radiation trace 12, a space between center points of the laser radiation marks 14 adjacent to each other is called a spot space. A line parallel to the width direction and passing through the center points of the laser radiation marks 14 that form the dotted line laser radiation trace 12 is called a center line of the dotted line laser radiation trace 12. A space between two of the center lines of the dotted line laser radiation traces 12 adjacent to one another is called a line space.

A plurality of the aforementioned dotted line laser radiation traces 12 was formed. These dotted line laser radiation traces 12 were made in directions parallel to each other.

A spot space SP1 (that is, the space between the center points of the laser radiation traces 14) and a line space LP1 (that is, the space between the center lines of the dotted line laser radiation traces 12) of the dotted line laser radiation traces 12 were as shown in Table 9.

The number density of the laser radiation marks (marks/$mm^2$) of the ribbon 10 was as shown in Table 9. The number density D of the laser radiation marks (marks/$mm^2$) was calculated by the following formula:

$$D=(1/d1)\times(1/d2)$$

In the formula, d1 represents the line space (unit: mm), d2 represents the spot space (unit: mm).

A condition of radiation of the pulse laser is as explained below.

<Conditions of Radiation of Pulse Laser>

A pulsed fiber laser (YLP-HP-2-A30-50-100), a product of IPG Photonics Corporation, was used as the laser oscillator. This laser oscillator uses an Yb-doped glass fiber as a laser medium, an oscillation wavelength of which is 1,064 nm. A beam diameter of the emitted laser beam at a collimator on an end of the fiber of this laser oscillator was 6.2 mm.

Meanwhile, the spot diameter of the laser beam on the free solidified surface of the sample piece was adjusted to be 60.8 μm. These adjustments of the beam diameter were performed with the following optical components: a beam expander (BE) and a condenser lens with fθ: f254 (that is, focal distance: 254 mm).

A beam mode M2 was set to 3.3 (multi-mode).

The laser output power was set to 2.0 mJ; the pulse width of the laser was set to 250 nsec.

A magnification of the beam by the BE was three folds with the focus of 0 mm. The focus mentioned here means a difference (absolute value) between the focal distance (254 mm) of the condenser lens and an actual distance from the condenser lens to the free solidified surface of the ribbon.

A relation of $D0=4\lambda f/\pi D$ (λ represents the wavelength of the laser, f represents the focal distance) holds between the incident beam diameter D and the spot diameter D0; therefore, there is a tendency that the spot diameter D0 decreases as the magnification of the beam by the BE increases (in other words, as the incident beam diameter D increases).

In the aforementioned conditions of radiation, a value obtained by dividing the laser output power (2.0 mJ) by beam diameter of the laser (60.8 μm) on the free solidified surface of the sample piece is defined as the energy density of the laser, the energy density is 0.689 J/$mm^2$ when expressed in the unit J/$mm^2$.

[Measurement and Evaluation]

The following measurements and evaluations were performed with respect to the laser-processed Fe-based amorphous alloy ribbon (the ribbon 10 in FIG. 4). Results are shown in Table 9.

[Maximum Cross-Sectional Height Rt of Laser-unprocessed Area]

A maximum cross-sectional height Rt of a portion other than the dotted line laser radiation traces 12 on the free solidified surface of the laser-processed Fe-based amorphous alloy ribbon (that is, a laser-unprocessed area) was measured with the evaluation length of 4.0 mm, the cutoff value of 0.8 mm, and the type of cutoff being 2RC (phase compensation) as complying with JIS B 0601: 2001. The direction of the evaluation length is set to be the casting direction of the material ribbon. More specifically, the aforementioned measurement of the maximum cross-sectional height Rt with the evaluation length of 4.0 mm is performed by continuously measuring the maximum cross-sectional height Rt five times with the cutoff value of 0.8 mm. The aforementioned measurement with the evaluation length of 4.0 mm was performed at three locations in the laser-unprocessed area; an average value of the values obtained from the three measurements was used as the maximum cross-sectional height Rt (pm) in the present example.

[Measurement of Iron Loss CL]

The iron loss CL of the laser-processed Fe-based amorphous alloy ribbon was measured with an AC magnetic measuring instrument under sine wave excitation under two conditions, namely, the condition that the frequency is 60 Hz and the magnetic flux density is 1.45 T, and the condition that the frequency is 60 Hz and the magnetic flux density is 1.50 T.

[Measurement of Exciting Power VA]

The exciting power VA of the laser-processed Fe-based amorphous alloy ribbon was measured with the AC magnetic measuring instrument under sine wave excitation under two conditions, namely, the condition that the frequency is 60 Hz and the magnetic flux density is 1.45 T, and the condition that the frequency is 60 Hz and the magnetic flux density is 1.50 T.

[Measurement of Magnetic Flux Density B0.081]

The magnetic flux density B0.08 of the laser-processed Fe-based amorphous alloy ribbon was measured under the condition that the frequency is 60 Hz and the magnetic field is 8 A/m.

[Comparison Example 101]

Comparison Example 101 was processed in the same manner as Example 101 except that the laser processing was not performed on Comparison Example 101. Results are shown in Table 9 and Table 10.

[Examples 102 to 114, Comparison Examples 102 to 104]

Examples 102 to 114, and Comparison Examples 102 to 104 were processed in the same manner as Example 101 except that the combination of the spot space and the line space was changed as shown in Table 9 and Table 10. Results are shown in Table 9 and Table 10.

In these examples, values are different in the maximum cross-sectional height Rt; however, the maximum cross-sectional height Rt was not intentionally controlled. It is technically difficult to intentionally control the maximum cross-sectional height Rt when the maximum cross-sectional height Rt is in a range of 3.0 μm or less.

[Comparison Example 105]

Comparison Example 105 was evaluated in the same manner as Comparison Example 101 except that the ejection pressure of the molten metal and the nozzle gap were adjusted so that the maximum cross-sectional height Rt exceeded 3.0 μm. Results are shown in Table 10. A waveform unevenness was found formed on the free solidified surface of the Fe-based amorphous alloy ribbon in Comparison Example 105.

TABLE 9

| | Free Solidified Surface of Ribbon | | | | | Magnetic Characteristics | | | | |
|---|---|---|---|---|---|---|---|---|---|---|
| | | | Laser Processed | | | | | | | |
| | | | Area (Laser Radiation Marks) | | Number Density of | Iron | Exciting | Magnetic Flux | Iron | Exciting |
| | Laser Unprocessed Rt (μm) | Laser Output Power (mJ) | Spot Space SP1 (mm) | Line Space LP1 (mm) | Laser Radiation Marks (Marks/mm$^2$) | Loss CL (W/kg) at 1.45 T 60 Hz | Power VA (VA/kg) at 1.45 T 60 Hz | Density B0.08 (T) at 8 A/m 60 Hz | Loss CL (W/kg) at 1.50 T 60 Hz | Power VA (VA/kg) at 1.50 T 60 Hz |
| Comparison Example 101 | 1.0 | — | — | — | 0 | 0.168 | 0.183 | 1.51 | 0.176 | 0.244 |
| Comparison Example 102 | 1.0 | 2.0 | 0.05 | 20 | 1.00 | 0.088 | 0.518 | 1.48 | 0.098 | 0.789 |
| Example 101 | 1.6 | 2.0 | 0.10 | 20 | 0.50 | 0.104 | 0.200 | 1.52 | 0.113 | 0.293 |
| Example 102 | 1.2 | 2.0 | 0.15 | 20 | 0.33 | 0.095 | 0.165 | 1.54 | 0.107 | 0.267 |
| Example 103 | 1.1 | 2.0 | 0.20 | 20 | 0.25 | 0.108 | 0.140 | 1.55 | 0.122 | 0.211 |
| Example 104 | 1.3 | 2.0 | 0.25 | 20 | 0.20 | 0.108 | 0.134 | 1.55 | 0.118 | 0.192 |
| Example 105 | 1.5 | 2.0 | 0.30 | 20 | 0.17 | 0.124 | 0.146 | 1.55 | 0.131 | 0.209 |
| Example 106 | 2.4 | 2.0 | 0.40 | 20 | 0.13 | 0.119 | 0.143 | 1.54 | 0.135 | 0.230 |
| Example 107 | 1.6 | 2.0 | 0.45 | 20 | 0.11 | 0.138 | 0.160 | 1.54 | 0.150 | 0.216 |
| Example 108 | 1.3 | 2.0 | 0.50 | 20 | 0.10 | 0.147 | 0.160 | 1.54 | 0.161 | 0.199 |

TABLE 10

| | Free Solidified Surface of Ribbon | | | | | Magnetic Characteristics | | | | |
|---|---|---|---|---|---|---|---|---|---|---|
| | | | Laser Processed | | | | | | | |
| | | | Area (Laser Radiation Marks) | | Number Density of | Iron | Exciting | Magnetic Flux | Iron | Exciting |
| | Laser Unprocessed Rt (μm) | Laser Output Power (mJ) | Spot Space SP1 (mm) | Line Space LP1 (mm) | Laser Radiation Marks (Marks/mm$^2$) | Loss CL (W/kg) at 1.45 T 60 Hz | Power VA (VA/kg) at 1.45 T 60 Hz | Density B0.08 (T) at 8 A/m 60 Hz | Loss CL (W/kg) at 1.50 T 60 Hz | Power VA (VA/kg) at 1.50 T 60 Hz |
| Comparison Example 101 | 1.0 | — | — | — | 0 | 0.168 | 0.183 | 1.51 | 0.176 | 0.244 |
| Example 109 | 1.3 | 2.0 | 0.20 | 60 | 0.08 | 0.146 | 0.170 | 1.52 | 0.168 | 0.238 |
| Example 110 | 1.7 | 2.0 | 0.20 | 50 | 0.10 | 0.136 | 0.148 | 1.55 | 0.151 | 0.231 |
| Example 111 | 1.4 | 2.0 | 0.20 | 40 | 0.13 | 0.130 | 0.153 | 1.55 | 0.142 | 0.253 |
| Example 112 | 2.0 | 2.0 | 0.20 | 30 | 0.17 | 0.123 | 0.136 | 1.54 | 0.130 | 0.154 |
| Example 103 | 1.1 | 2.0 | 0.20 | 20 | 0.25 | 0.108 | 0.140 | 1.55 | 0.122 | 0.211 |
| Example 113 | 1.4 | 2.0 | 0.20 | 15 | 0.33 | 0.099 | 0.149 | 1.55 | 0.106 | 0.196 |
| Example 114 | 1.2 | 2.0 | 0.20 | 10 | 0.50 | 0.085 | 0.145 | 1.56 | 0.094 | 0.187 |
| Comparison Example 103 | 1.7 | 2.0 | 0.20 | 7.5 | 0.67 | 0.079 | 0.210 | 1.50 | 0.091 | 0.282 |
| Comparison Example 104 | 1.4 | 2.0 | 0.20 | 5 | 1.00 | 0.075 | 0.255 | 1.48 | 0.085 | 0.329 |
| Comparison Example 105 | 3.2 | — | — | — | 0 | 0.101 | 0.214 | 1.51 | 0.117 | 0.316 |

As shown in Table 9 and Table 10, the iron loss CL and the exciting power

VA of the Fe-based amorphous alloy ribbons of Examples 101 to 114, having the spot space of from 0.10 mm to 0.50 mm and the number density D of the laser radiation marks of from 0.05 marks/mm$^2$ to 0.50 marks/mm$^2$, were reduced under the condition that the magnetic flux density was 1.45 T. The line spaces in Examples 101 to 114 were from 10 mm to 60 mm.

Meanwhile, with respect to the Fe-based amorphous alloy ribbon of Comparison Example 101 that had no laser radiation traces formed thereon, the iron loss CL was high.

With respect to the Fe-based amorphous alloy ribbon of Comparison Example 102 where the spot space was less than 0.10 mm, the exciting power VA was high although the iron loss CL was reduced.

With respect to the Fe-based amorphous alloy ribbons of Comparison Examples 103 and 104 where the line space was less than 10 mm, the exciting power VA was high although the iron loss CL was reduced.

With respect to the Fe-based amorphous alloy ribbon of Comparison Example 105 where no laser radiation traces were formed and the maximum cross-sectional height Rt exceeded 3.0 μm in the laser-unprocessed area on the free solidified surface, the exciting power VA was high although the iron loss CL was reduced.

[Shape of Laser Radiation Marks]

Planar-view shapes of the laser radiation marks on the Fe-based amorphous alloy ribbons of Examples 101 to 114 were observed with an optical microscope. In all of the examples, the planar-view shapes of the laser radiation marks were crown-like shapes. The crown-like shape mentioned here means that there are traces of scattered molten alloy left around the edges of the laser radiation marks.

With respect to the Fe-based amorphous alloy ribbons of Examples 101 to 114 having the chemical composition of $Fe_{82}Si_4B_{14}$, the saturation magnetic flux density Bs was 1.63 T.

In Examples 101 to 114, the iron loss CL and the exciting power VA under the condition that the magnetic flux density was 1.45 T included assumptions that the Fe-based amorphous alloy ribbons were used with the operating magnetic flux density Bm that would satisfy that the Bm/Bs ratio was 0.89 (=1.45/1.63); and iron loss CL and the exciting power VA under the condition that the magnetic flux density was 1.50 T included assumptions that the Fe-based amorphous alloy ribbons were used with the operating magnetic flux density Bm that would satisfy that the Bm/Bs ratio was 0.92 (=1.50/1.63).

According to the results shown in Table 9 and Table 10, the Fe-based amorphous alloy ribbons from Examples 101 to 114 may reduce the iron loss and inhibit the exciting power, even when used with the operating magnetic flux density Bm that would satisfy that the Bm/Bs ratio is in a range from 0.88 to 0.94.

What is claimed is:

1. A transformer comprising:

an iron core formed by using an Fe-based amorphous alloy ribbon; and a winding wound around the iron core, wherein the Fe-based amorphous alloy ribbon includes dotted line laser radiation traces on at least a first surface of the Fe-based amorphous alloy ribbon, wherein the dotted line laser radiation traces are arranged in a casting direction of the Fe-based amorphous alloy ribbon, wherein each dotted line laser radiation trace extends along a width direction of the Fe-based amorphous alloy ribbon, wherein the width direction is orthogonal to the casting direction, wherein the dotted line laser radiation trace is formed by arranging laser radiation marks along the width direction, wherein a space between center lines of the dotted line laser radiation traces adjacent to one another at a central part of the Fe-based amorphous alloy ribbon in the width direction is a line space, wherein a space between adjacent two of the center points is a spot space, wherein the spot space is from 0.10 mm to 0.50 mm, wherein, in a case in which the line space is d1 (mm), the spot space is d2 (mm), and number density D of the laser radiation marks is determined by a following formula: $D=(1/d1)\times(1/d2)$, the number density D of the laser radiation marks is from 0.05 marks/mm$^2$ to 0.50 marks/mm$^2$, and wherein an iron loss of the Fe-based amorphous alloy ribbon in a single sheet is 0.150 W/kg or less at a frequency of 60 Hz and a magnetic flux density of 1.45 T.

2. The transformer according to claim 1, wherein the transformer is a single-phase transformer, and wherein a no-load loss of the transformer per weight of the iron core is 0.15 W/kg or less at 50 Hz, or 0.19 W/kg or less at 60 Hz.

3. The transformer according to claim 1, wherein the transformer is a three-phase transformer, and wherein a no-load loss of the transformer per weight of the iron core is 0.19 W/kg or less at 50 Hz, or 0.24 W/kg or less at 60 Hz.

4. The transformer according to claim 1, wherein a rated capacity of the transformer is 10 kVA or more.

5. The transformer according to claim 1, wherein the line space d1 is from 10 mm to 60 mm.

6. The transformer according to claim 1, wherein a proportion of a length of the dotted line laser radiation trace to a total width of the Fe-based amorphous alloy ribbon is in a range from 10% to 50% each in both directions from a midpoint of the Fe-based amorphous alloy ribbon towards ends of the Fe-based amorphous alloy ribbon in the width direction.

7. The transformer according to claim 1, wherein a thickness of the Fe-based amorphous alloy ribbon is from 18 μm to 35 μm.

8. The transformer according to claim 1, wherein, in a case in which the Fe-based amorphous alloy ribbon contains Fe, Si, B, and an impurity with a total content of Fe, Si, and B in the Fe-based amorphous alloy ribbon being 100 atomic %, a content of Fe is 78 atomic % or more, a content of B is 10 atomic % or more, a total content of B and Si is from 17 atomic % to 22 atomic %.

9. The transformer according to claim 1, wherein the Fe-based amorphous alloy ribbon includes a free solidified surface and a roll contacting surface, and wherein a maximum cross-sectional height Rt on the free solidified surface, except for a portion where the dotted line laser radiation traces are formed, is 3.0 μm or less.

10. The transformer according to claim 1, wherein, the dotted line laser radiation traces are formed at least inside an area of central six-eighths of eight equal sections of the Fe-based amorphous alloy ribbon divided in the width direction, excluding two-eights on both ends of the Fe-based amorphous alloy ribbon.

* * * * *